US010881948B2

(12) United States Patent
Ziran et al.

(10) Patent No.: US 10,881,948 B2
(45) Date of Patent: Jan. 5, 2021

(54) GAME TILE SYSTEM

(71) Applicant: National Entertainment Collectibles Association, Inc., Hillside, NJ (US)

(72) Inventors: Justin Ziran, San Marcos, CA (US); Chas Delong, Tacoma, WA (US); Bryan Kinsella, Chapel Hill, SC (US); Josh Piezas, Cranford, NJ (US)

(73) Assignee: National Entertainment Collectibles Association, Inc., Hillside, NJ (US)

( * ) Notice: Subject to any disclaimer, the term of this patent is extended or adjusted under 35 U.S.C. 154(b) by 0 days.

(21) Appl. No.: 16/837,862

(22) Filed: Apr. 1, 2020

(65) Prior Publication Data

US 2020/0306618 A1 Oct. 1, 2020

Related U.S. Application Data

(60) Provisional application No. 62/827,821, filed on Apr. 1, 2019, provisional application No. 62/950,576, filed on Dec. 19, 2019.

(51) Int. Cl.
*A63F 3/00* (2006.01)
*A63H 33/04* (2006.01)
(Continued)

(52) U.S. Cl.
CPC ..... *A63F 3/00214* (2013.01); *A63F 3/00075* (2013.01); *A63F 3/00176* (2013.01);
(Continued)

(58) Field of Classification Search
CPC .. A63F 2003/00388; A63F 2003/00391; A63F 2003/00359; A63F 2003/00362;
(Continued)

(56) References Cited

U.S. PATENT DOCUMENTS 2,143,667 A * 1/1939 Troiel ..... A63H 33/105
446/122
2,320,292 A * 5/1943 Nelson ..... A63H 33/108
446/122

(Continued)

FOREIGN PATENT DOCUMENTS

CA 2515821 A1 * 2/2006 ..... A63F 3/00
GB 26707 * 4/1913

OTHER PUBLICATIONS

International Search Report of the International Searching Authority dated Jun. 24, 2020, issued in connection with International Application No. PCT/US20/26244 (3 pages).

(Continued)

*Primary Examiner* — Benjamin Layno
(74) *Attorney, Agent, or Firm* — McCarter & English, LLP

(57) ABSTRACT

A tile game system is provided that includes a plurality of two-dimensional and three-dimensional components. The two-dimensional components can include a plurality of modular tiles provided in various sizes and configurations that can be joined together to form a grid-based gameplay area. The three-dimensional components can include external boundaries for the gameplay area, internal boundaries, terrain elements such as columns and staircases, and game figures. According to aspects of the present disclosure, the external and internal boundaries can be provided with recessed sections that allow a game figure to be contained within a single grid square and prevent the grid of the gameplay area from becoming warped. According to some aspects of the present disclosure the internal and external boundaries can be illuminated and provided with removable and interchangeable light-permeable skins that allow a user to switch between various illuminated designs.

20 Claims, 24 Drawing Sheets

(51) Int. Cl.
*A63H 33/10* (2006.01)
*A63H 33/06* (2006.01)

(52) U.S. Cl.
CPC ..... *A63F 3/00643* (2013.01); *A63F 2003/00359* (2013.01); *A63F 2003/00362* (2013.01); *A63F 2003/00388* (2013.01); *A63F 2003/00391* (2013.01); *A63F 2003/00463* (2013.01); *A63F 2003/00646* (2013.01); *A63H 33/04* (2013.01); *A63H 33/042* (2013.01); *A63H 33/046* (2013.01); *A63H 33/062* (2013.01); *A63H 33/101* (2013.01); *A63H 33/105* (2013.01); *A63H 33/107* (2013.01)

(58) Field of Classification Search
CPC ..... A63F 3/00214; A63F 3/00261; A63F 2003/00646; A63H 33/101; A63H 33/105; A63H 33/107; A63H 33/042; A63H 33/04; A63H 33/046; A63H 33/062
USPC ..... 273/276, 237, 239, 241, 283, 284, 287, 273/282.3, 282.1
See application file for complete search history.

(56) References Cited

U.S. PATENT DOCUMENTS 2,461,535 A * 2/1949 Erhardt ..... A63H 33/088 446/104
4,696,476 A * 9/1987 Eplett ..... A63F 3/00214 273/241
5,683,087 A * 11/1997 Henshaw ..... A63F 9/183 273/237
7,934,724 B1 * 5/2011 Esquivel ..... A63F 3/0023 273/241
2003/0077975 A1 * 4/2003 Barringer ..... A63H 33/10 446/108
2004/0051244 A1 3/2004 Weisman
2006/0043674 A1 3/2006 Van Ness
2007/0281580 A1 * 12/2007 Sambenedetto ..... A63H 33/08 446/124
2018/0229141 A1 * 8/2018 Miller ..... A63D 15/003

OTHER PUBLICATIONS

Written Opinion of the International Searching Authority dated Jun. 24, 2020, issued in connection with International Application No. PCT/US20/26244 (9 pages).
Edwards, " WarLock Tiles Advances Starter Set—WizKids," PHD Games, Sep. 18, 2019 https://www.phdgames.com/warlock-tiles-starter-sets-wizkids/ (3 pages).
"Dragonlock™ Ultimate: Dungeon Starter Set FDG0160," Fat Dragon Games, Mar. 9, 2019, https://web.archive.org/web/20190309032149/http://www.fatdragongames.com/fdgfiles/?page_id=2658 (7 pages).

* cited by examiner

GAME TILE SYSTEM

CROSS-REFERENCE TO RELATED APPLICATIONS

This application claims priority to U.S. Provisional Application No. 62/827,821, filed Apr. 1, 2019, and U.S. Provisional Application No. 62/950,576, filed Dec. 19, 2019, the entire disclosures of which are hereby expressly incorporated by reference.

BACKGROUND

Field of the Disclosure

The present disclosure relates to a customizable game board tile system that allows the construction of a grid layout across a playable area.

Related Art

In the realm of role-playing games ("RPG"), a square-gridded map or board is often used as the environment in which play is conducted. This consistent and repeating square-grid creates the world that establishes relative position of all players—much the same way a chess board establishes possible positions of play. Two players who are X squares away from each may interact only by the rules governing the X interval. As RPG entertainment has evolved, game environments have advanced from one-dimensional paper-based maps to sophisticated three-dimensional ("3D") simulations of natural topographies, landscapes, and architectures—particularly dungeons—defined as an interior space with rooms, hallways, hidden rooms, hidden passages, etc. In the last example of architectures, it is the creation of physical 3D walls (defined as things that separate) that—while advancing the immersive experience of RPG play, has warped the continuity of the square-gridded map world that is the fabric of excruciatingly detailed game play. Walls (and other separating things such as doors and windows)—whether on the border of the tile grid and table, or internal to the tile grid—creating hall ways, rooms, building exteriors, fences and other structures where a clear delineation of one side and the other side is required, impose a real physical thickness forcing itself on a three-dimensional square-grid. In paper maps, a wall, or boundary, is a decorated line that can be imagined and re-imagined as needed. In sophisticated 3D environments, boundaries, as they are currently executed—if not the width of the square-grid, either subtract space from the adjacent grid squares OR expand the grid by some arbitrary measurement not in line with the natural space of the game. For a game paying special attention to detail—real or fantastic, the inability for game pieces to occupy the space—the grid squares, they rightfully should can cause play inconsistencies as much as physical piece placement problems; often inciting the passions of a very committed game community.

Accordingly, what is needed, but has not been developed, is a grid-based three-dimensional game system that provided for the creation of three-dimensional internal barriers, without adversely impacting the continuity of the grid-based game area.

SUMMARY

The present disclosure relates to a game tile system addressing a modularly customizable play-space created via maintenance of a rectilinear grid layout. The square or rectangular grid layout can be consistent and uninterrupted throughout the customizable play-space. The architecture of the play space utilizes a boundary mechanism for the secure attachment of modular boundaries to a modular tile base such that the base of a game-piece may fully occupy the grid-square adjacent to the boundary. It also establishes a continuous square grid via a boundary locking mechanism with a limited horizontal fluctuation to the square grid created by three-dimensional interlocking tiles.

BRIEF DESCRIPTION OF THE DRAWINGS

The foregoing features of the disclosure will be apparent from the following Detailed Description, taken in connection with the accompanying drawings, in which.

DETAILED DESCRIPTION

The present disclosure relates to a customizable game board tile system that allows the construction of a grid layout across a playable area. The present disclosure is not limited to embodiments having specific dimensions. Thus, any dimensions provided herein are exemplary and are not intended to limit the scope of the present disclosure.

Figure 1:
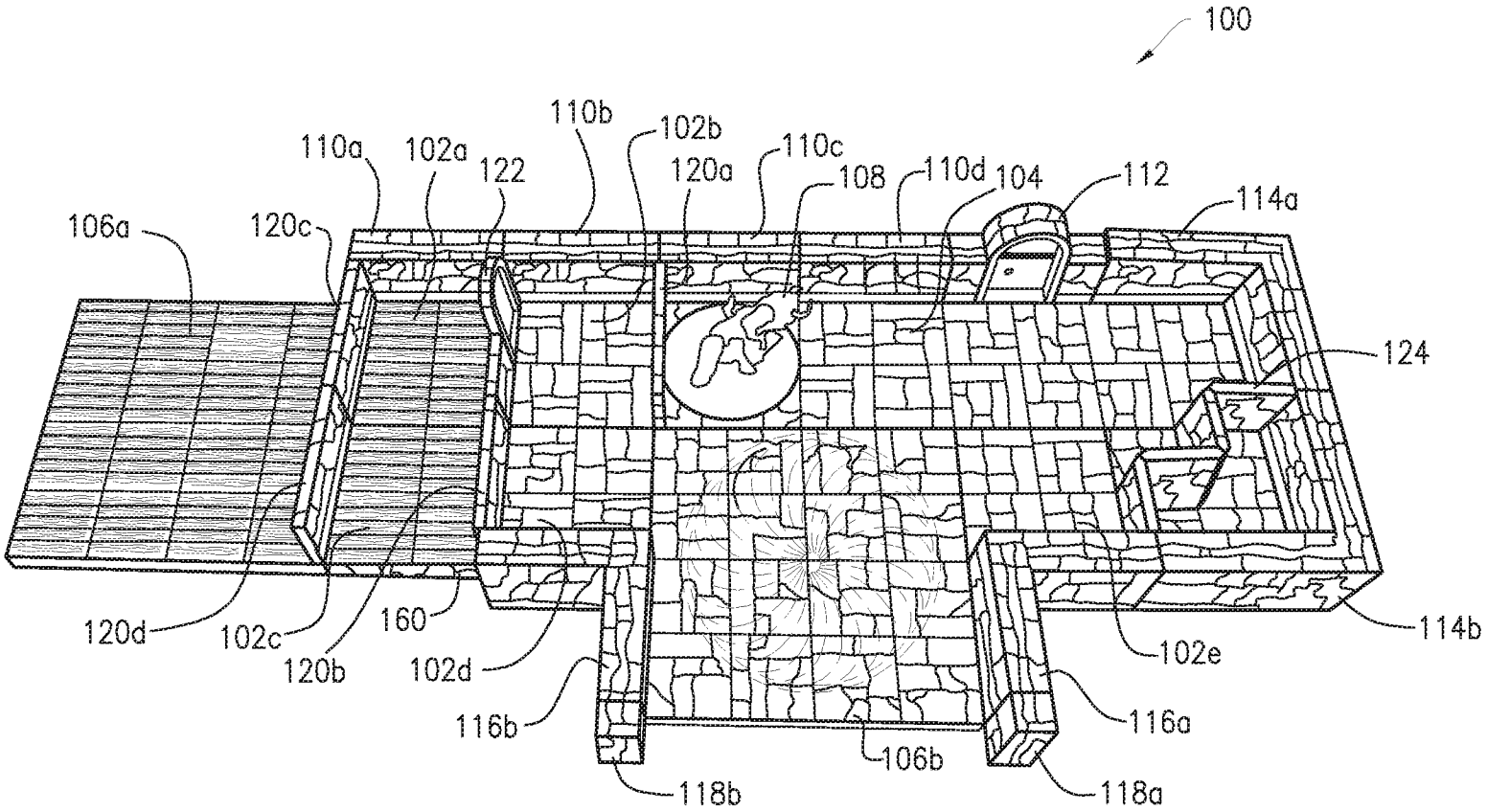
FIG. 1 is a perspective view of components of a tile game system, assembled in an exemplary configuration, according to the present disclosure.

FIG. 1 is a perspective view of an exemplary tile game system, indicated generally at 100, of the present disclosure. The tile game system 100 includes a plurality of modular components that can be arranged to form a customized playable area. One or more game FIGS. 108 and/or game components 188 (see FIG. 21) can be positioned within the customized playable area and moved by users (e.g., players) during gameplay.

The components include a plurality of tiles, provided in various sizes and configurations, which can be connected to form a continuous grid-based playing surface. The components can also include external boundaries, internal boundaries, and other gameplay elements. As shown in FIG. 1, the tile game system 100 can include 2×2 tiles 102*a-d*, one or more 2×8 tiles 104, and one or more 4×4 tiles 106*a* and 106*b*. The 2×2 tiles 102*a-d* can represent a base unit, with other tiles of the game system 100 having dimensions that can represent multiples of the base unit. For example, a 2×8 tile can have the same dimensions as four (4) 2×2 tiles arranged along side each other (e.g., in a row) and a 4×4 tile can have the same dimensions as four (4) 2×2 tiles arranged in a square pattern. As such, any number of the tiles disclosed herein can be arranged to form a continuous repeating grid pattern having a 1×1 base unit (e.g., a grid square 150, shown in FIG. 4). The given dimensions of the tiles (e.g., 1×1, 1×4, and 2×2) represent arbitrary units and could represent any real-world dimension. Of course, the tiles do not have to form a grid with square base units and tiles of other shapes (e.g., rectangles, triangles, hexagons, etc.) can be used to form a continuous grid pattern for the playing surface. Additionally, the tiles of the present disclosure can include other shapes having non-linear sides (e.g., curves), a mixture of linear and non-linear sides, and can be three dimensional (e.g., not being a flat tile). For example, one or more tiles of the present disclosure can be formed as tunnels that represent naturally occurring cave systems. Furthermore, the tile game system 100 of the present disclosure can include tiles having one or more configurations. As such, tiles having linear sides and forming a rectilinear grid pattern (e.g., as shown in FIG. 1) can be joined with tiles having curved sides that do not form a rectilinear, or any other, grid pattern.

As shown in FIG. 1, the components can also include, but are not limited to, one or more external boundaries 110*a-d*, external boundaries with design features (e.g., doors, windows, wall treatments, etc.) 112, exterior wall corners 114*a* and 114*b*, interior wall corners 116*a* and 116*b*, exterior boundary caps 118*a* and 118*b*, interior boundaries 120*a-d*, interior boundaries with design features (e.g., doors, windows, wall treatments, etc.) 122, and adjustable internal boundaries 124.

Figure 2:
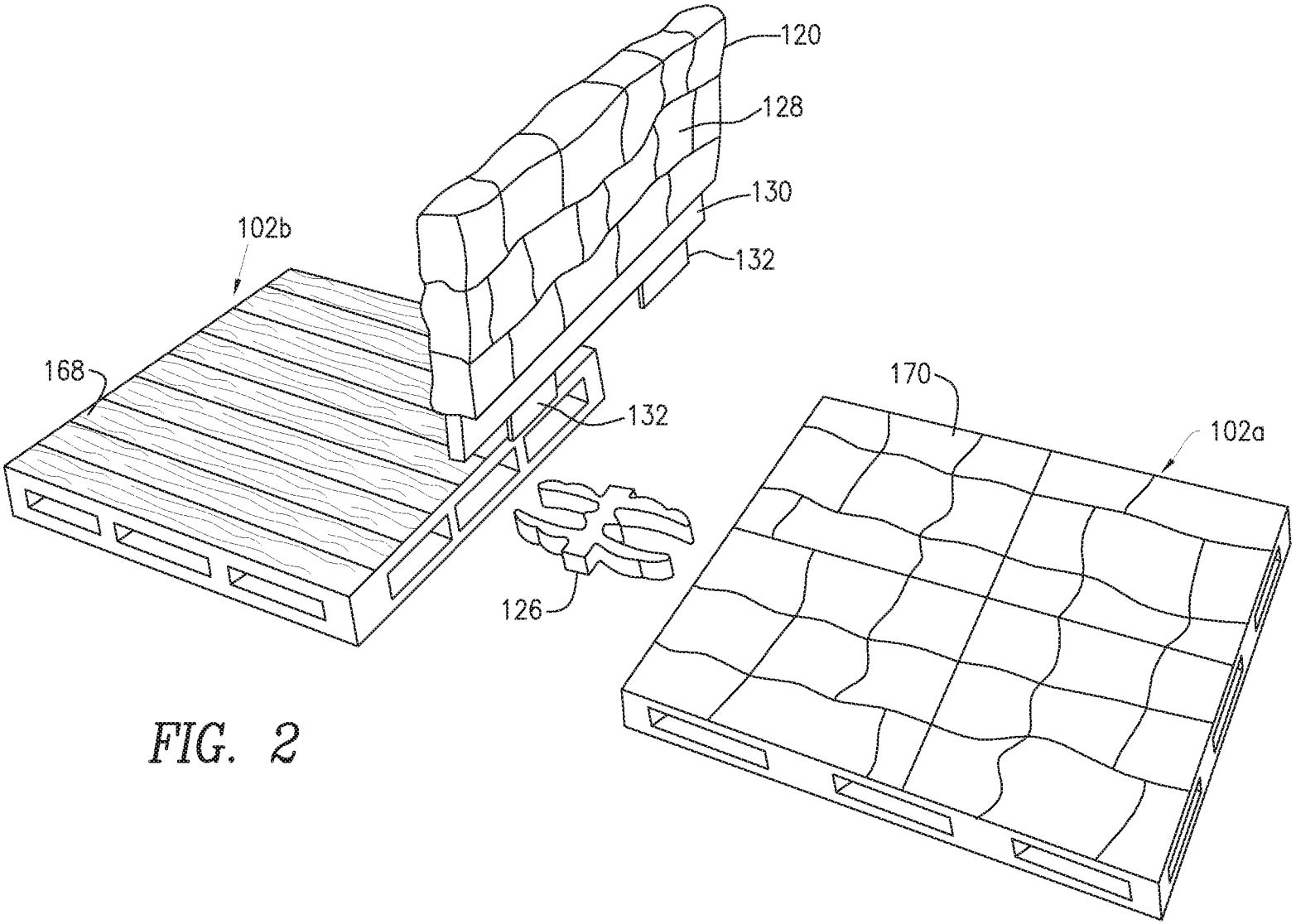
FIG. 2 is an exploded view of interior components of the tile game system, illustrating connections therebetween.

FIG. 2 is an exploded view of components of the tile game system 100, illustrating connections therebetween. More specifically, the components of the tile game system 100 shown in FIG. 2 include a first modular base tile 102*a*, a second modular base tile 102*b*, an internal boundary 120, and a locking clip 126. As shown, internal boundary 120 includes a decorative section 128, a recessed decorative section 130, and one or more attachment sections 132. Attachment sections 132 protrude downward from the recessed decorative section 130. The attachment sections 132 can be, for example, rigid, partly rigid, plastic, etc.

As shown, the attachment sections 132 of internal boundary 120 can be configured as two (2) metal plates inserted between the adjacent sides of the modular base tiles 102*a* and 102*b*, such that each of the two (2) protruding metal plates is on either side of the locking clip 126. Furthermore, when assembled (see FIG. 3), the recessed decorative section 130 begins at the point where the adjacent sides of tiles 102*a* and 102*b* no longer contact attachment sections 132 and continues upward until decorative section 128. The attachments sections 132 of internal boundary 120, or other game components described herein (e.g., other internal boundaries, adjustable boundaries, illuminated boundaries, terrain elements, and the like), can be inserted between the adjacent sides of the modular base tiles 102*a* and 102*b* at any time (e.g., before, during, or after connection of the modular base tiles), for example, by sliding the attachment sections 132 into a small gap between the adjacent sides of the modular base tiles 102*a* and 102*b*. Likewise, the attachments sections 132 of internal boundary 120 can be removed at any time by sliding them out from between the modular base tiles. As such, game components having attachment sections 132, such as internal boundary 120, can be quickly inserted and removed, thereby enabling a user quickly reconfigure the gameplay area of the of the tile game system 100. Furthermore, adjacent modular base tiles (e.g., tiles 102*a* and 102*b*) that are joined together (e.g., by clip 126) do not need to be disassembled, or significantly displaced, in order to insert or remove a game component having the attachment sections 132 from the game play area. Accordingly, a user can reconfigure game components having the attachment sections 132 within the game play area, without reconfiguring the modular tiles thereof.

According to other aspects of the present disclosure, the internal boundary 120 can include a decorative top section having a reduced thickness and a bottom attachment section, which can perform the functions of the decorative section 128, the recessed decorative section 130, and the attachment sections 132, discussed above. For example, the decorative top section of reduced thickness can have a height that encompasses the combined heights of the recessed decorative section 130 and the decorative section 128 of internal boundary 120 and the decorative top section can have, for example, a thickness at any point along its height, that is no greater than the thickness of the recessed decorative section 130, so that the thickness of the decorative top section is sufficient to maintain the secure attachment of the bottom attachment section.

According to other aspects of the present disclosure, the attachment sections 132 of internal boundary 120 can be composed of any rigid or partly rigid production material, including metal or plastic. The attachment sections 132 can be configured in any plate or non-plate format that inserts between the modular base tiles 102*a* and 102*b*. Because the attachment sections 132 are retained between the modular base tiles 102*a* and 102*b*, the internal boundary 120 is limited in rotational motion along the axis of the downward protrusions 132 and limited in back and forth tipping motion along the axis defined by the length of the internal boundary 120.

For example, attachment sections 132 can be configured as metal posts, metal wires, plastic posts, or any other rigid or partly rigid material in a post-of-minimal-diameter format that provides structural rigidity of the decorative section 128 and the decorative recessed section 130 of the internal boundary 120 (or the thin decorative top section and bottom attachment section of the alternate internal boundary, described above), relative to the base tiles 102*a* and 102*b*, and can be configured to be less than or equal to the width of a gap 134 (see FIG. 3) between adjacent sides of the modular base tiles 102*a* and 102*b* when connected via locking clip 126.

According to other aspects of the present disclosure, the attachment sections 132 can be configured as a single thin plate or one or more (non-plate) posts positioned on one side of the locking clip 126 when inserted between the modular base tiles 102*a* and 102*b*. In this example, two protruding posts or a single thin plate protrusion can perform the same function as the attachment sections 132, thereby limiting rotational and tipping motion of the internal boundary 120.

The modular base tiles described herein can be reversible, with a first design side and a second design side on the respective top and bottom sides thereof, such that each side can display a different type of surface material (e.g., wood planks vs. stone slabs). The surface material designs for the modular base tiles 102 can also include naturally forming wood, stone, other organic textures, and the like. For example, as shown in FIG. 2, modular base tile 102*a* can include a first design side 170 with stone slab design elements and a second design side 168 with wood plank design elements. Modular base tile 102*b* can be similarly configured, including a first design side 170 with stone slab design elements and a second design side 168 with wood plank design elements. Furthermore, the surface details of the first and second design sides can be sculpted/manufactured such that design details across the grid square crest at the same height allowing a round (or square) game figure base to sit flat on the surface.

Figure 3:
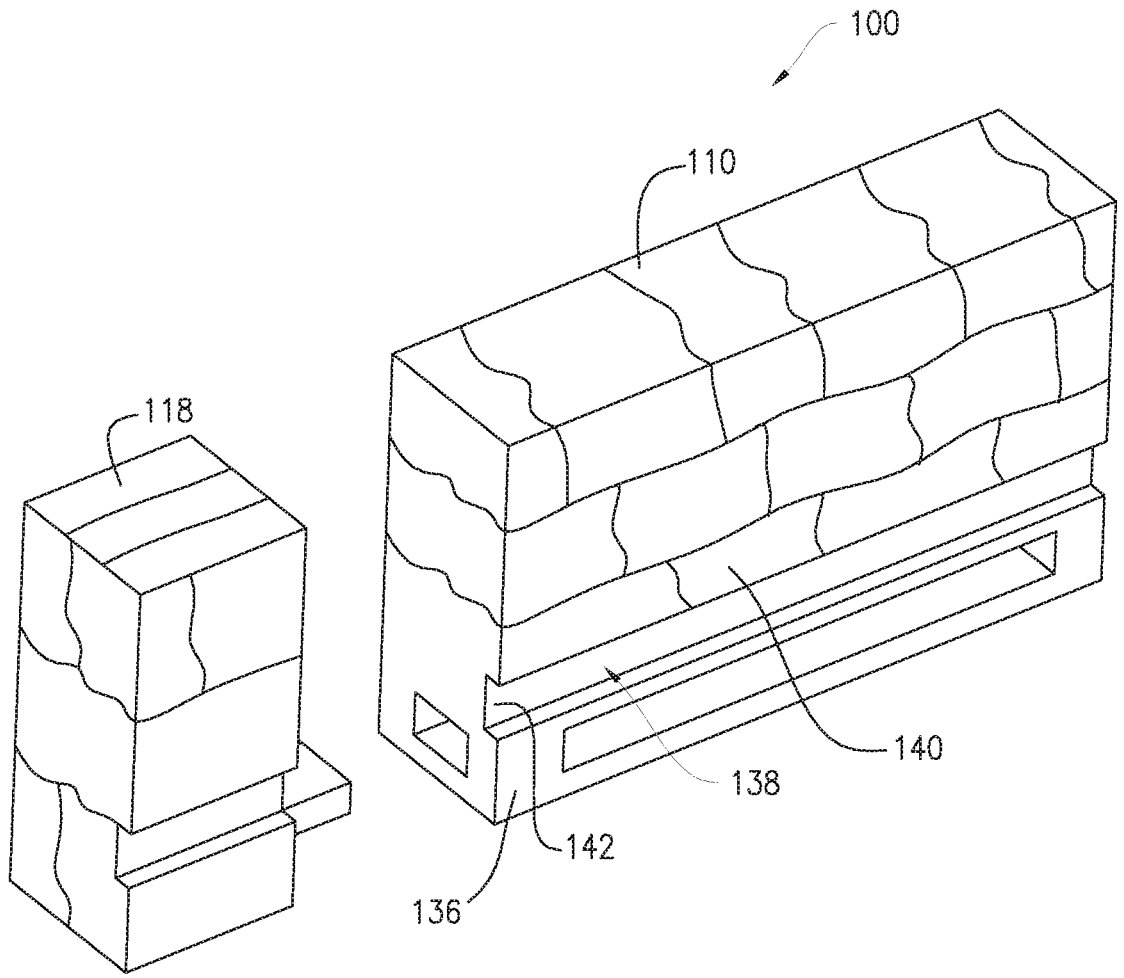
FIG. 3 is an exploded view of external components of the tile game system, illustrating connections therebetween.

FIG. 3 is an exploded view of components of the tile game system 100, illustrating connections therebetween. More specifically, the components of the tile game system 100 shown in FIG. 3 include an external boundary 110 and an exterior boundary cap 118. As shown, external boundary 110 includes a connecting section 136, a decorative recessed section 138 extending from the connecting section 136 (from a height generally even with the top surfaces of the modular base tiles 102*a* and 102*b*) and a decorative section 140.

According to some aspects of the present disclosure, external boundary 110, rather than including the decorative section 140, the recessed decorative section 138, and the connecting section 136, can include, for example, two (2) sections, for example, an external thin decorative top section and an external bottom connecting section. In this embodiment, the external thin decorative top section can be formed such that its height is generally equal to the combined heights of the recessed decorative section 138 and the decorative section 140 and the external thin decorative top section can have, for example, a thickness, at any point along its height, that is less than or equal to the thickness of the recessed decorative section 138, discussed in connection with FIG. 3. The thickness of the recessed decorative section 138 can be the thickness along a vertical surface 142 emanating from connecting section 136 at a point no higher than a surface of the modular base tiles 102*a* or 102*b* and said vertical surface 142 can be positioned at the same distance from an edge 144 (see, e.g., FIG. 4) of an adjacent side of a base tile 102 as a vertical surface 146 of the decorative recessed section 130 of the interior boundary 120 is from the edge 144 of the modular base tiles 102*a* or 102*b* that is adjacent to interior boundary 120.

Figure 4:
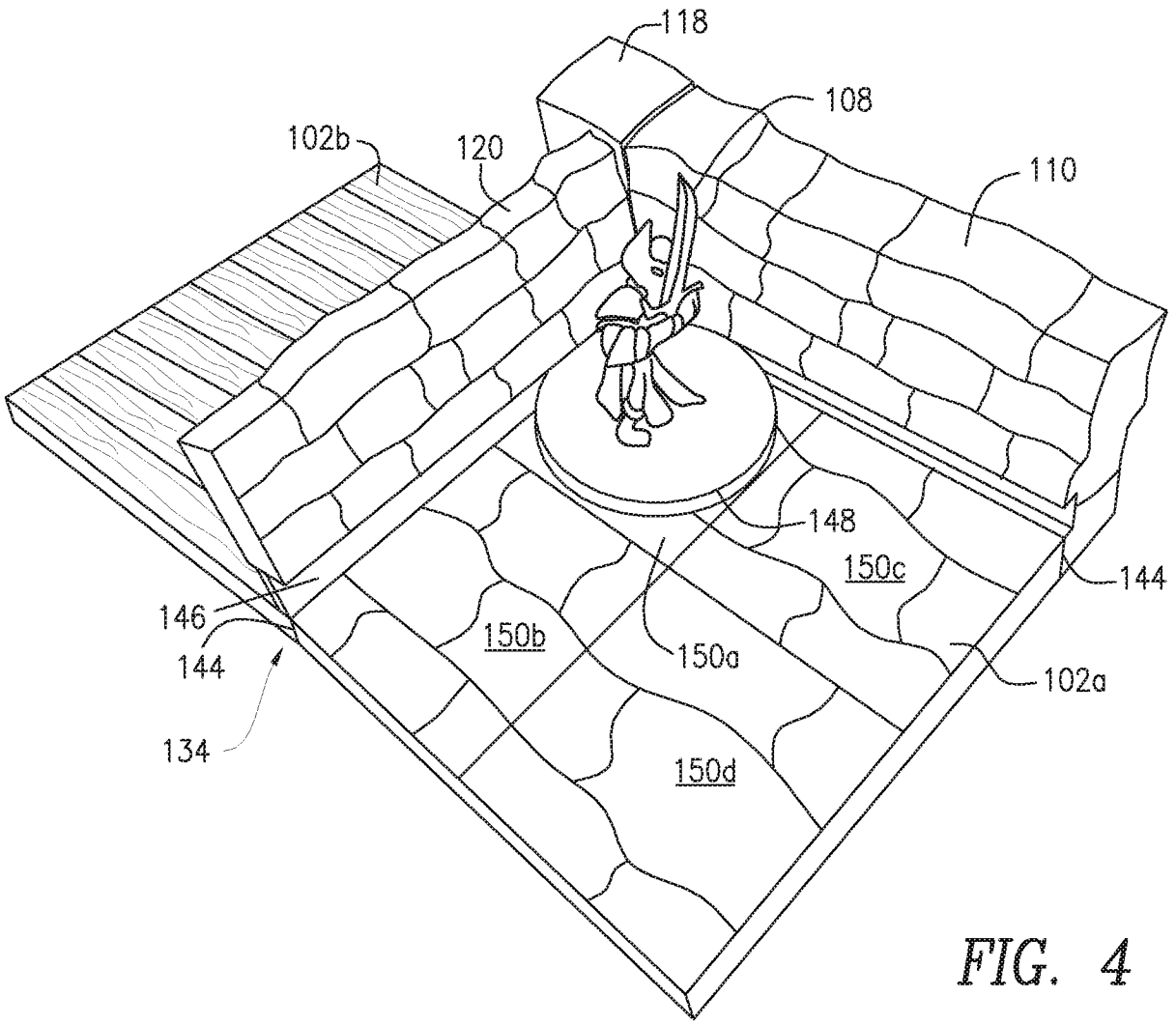
FIG. 4 is a perspective view of components of the tile game system, assembled in an exemplary configuration, according to the present disclosure.

FIG. 4 is a perspective view of the components of the tile game system 100, assembled in an exemplary configuration. More specifically, the configuration shown in FIG. 4 includes a first modular base tile 102*a*, a second modular base tile 102*b*, an internal boundary 120, an external boundary 110, an exterior boundary cap 118, and a game FIG. 108. The game FIG. 108 includes a base 148 with a diameter that can be equal to the length of a grid square 150*a*, which can be consistent across every square in the playing space. As shown in FIG. 4, the base of FIG. 108 can be configured to occupy only a single grid square 150*a*, without overlapping unintended grid squares 150*b-c*.

Making this single grid square occupation possible are the recessed sections 130 and 138 of the internal boundaries 120 and the external boundaries 110, respectively. The increased width of the decorative sections 128 and 140 (which would otherwise force base 148 out of grid square 150*a*) begins above base 148, such that the height of the recessed sections 130 and 138 is greater than the height of base 148 from the reference point of the surface plane of the modular base tiles 120*a* and 120*b*. This height discrepancy subsequently provides a clearance allowing a portion of base 148 to situate under a ridge created by the junction of the decorative sections 128 and 140 to decorative recessed sections 130 and 138, respectively.

Furthermore, while not a system requirement, the minimal height of the decorative recessed sections 130 and 138 required to provide clearance for base 148 ensures that the decorative sections 128 and 140 of the boundaries 120 and 110 are the primary visual component perceived during game play.

According to some aspects of the present disclosure, a larger game figure can be provided. For example, tile game system 100 can include a larger game figure on a base having a diameter that is a multiple of the length of the sides of grid squares 150. In this embodiment, the mechanics of appropriate grid square occupation are maintained, where the height of the base is less than the height of the recessed sections 130 and 138, allowing a portion of the base of the larger game figure to be positioned within the recessed areas defined by the decorative recessed sections 130 and 138 of the internal boundary 120 and external boundary 110, respectively. Accordingly, the base of the larger game figure can appropriately occupy a larger area created by the combination of, for example, grid squares 150*a-d*.

According to other aspects of the present disclosure, the base of game FIG. 108 can be implemented as a square with side lengths matching a grid square 150 or a multiple thereof, which illustrates the non-restrictive nature of the continuous square-grid tile system 100. As such, the size of the base of the game figure is only limited by the size of the game play area.

Figure 5:
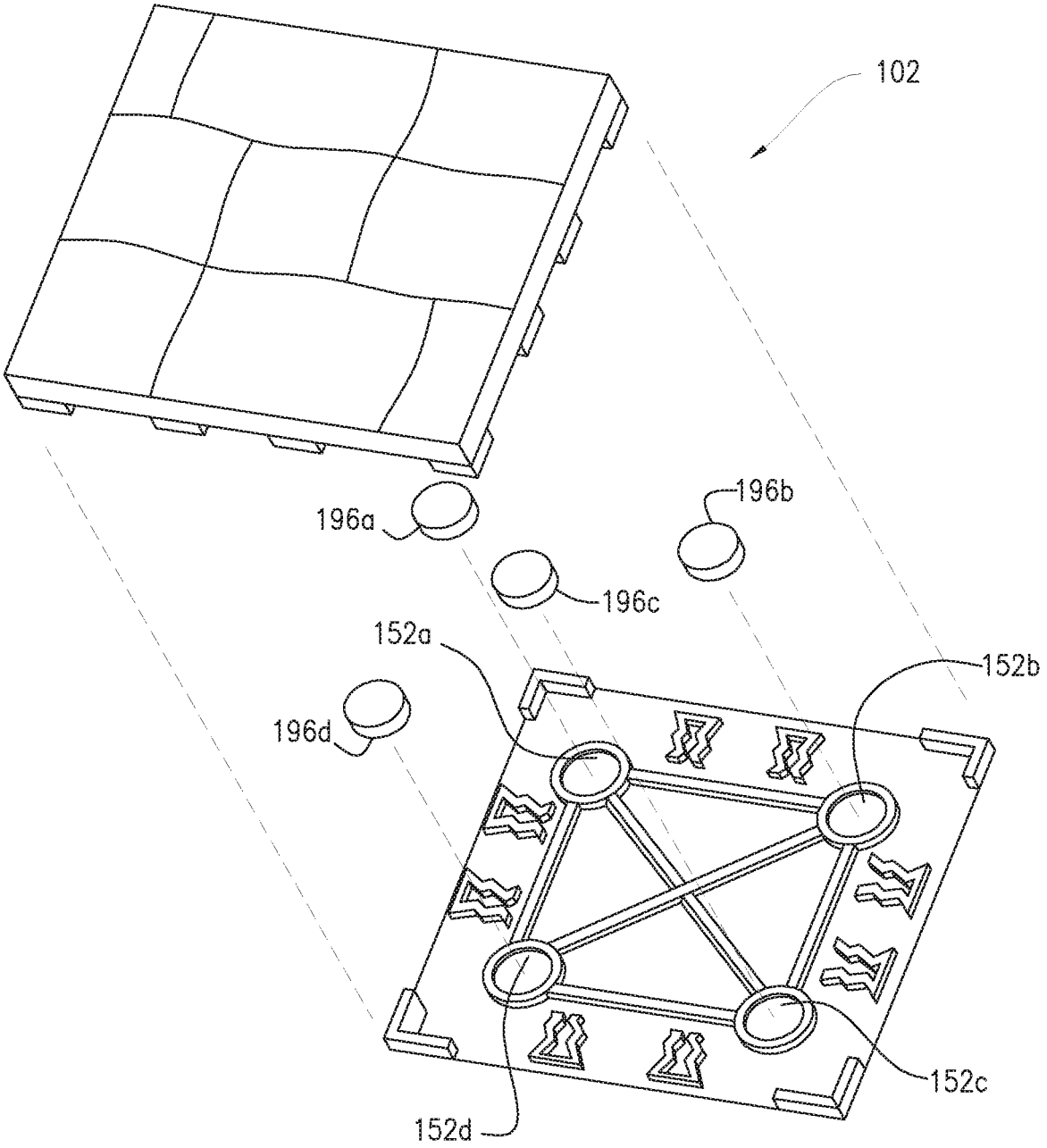
FIG. 5 is an exploded view of a modular base tile of the tile game system according to the present disclosure.

FIG. 5 is an exploded view of a base tile 102 showing multiple internal recessed spaces 152*a-d* inside the modular base tile 102 to allow insertion of magnets 196*a-d*, which can enable a magnetic connection to game components placed on top of the tiles, such as furnishings, terrain, and building components such as columns.

Figure 6:
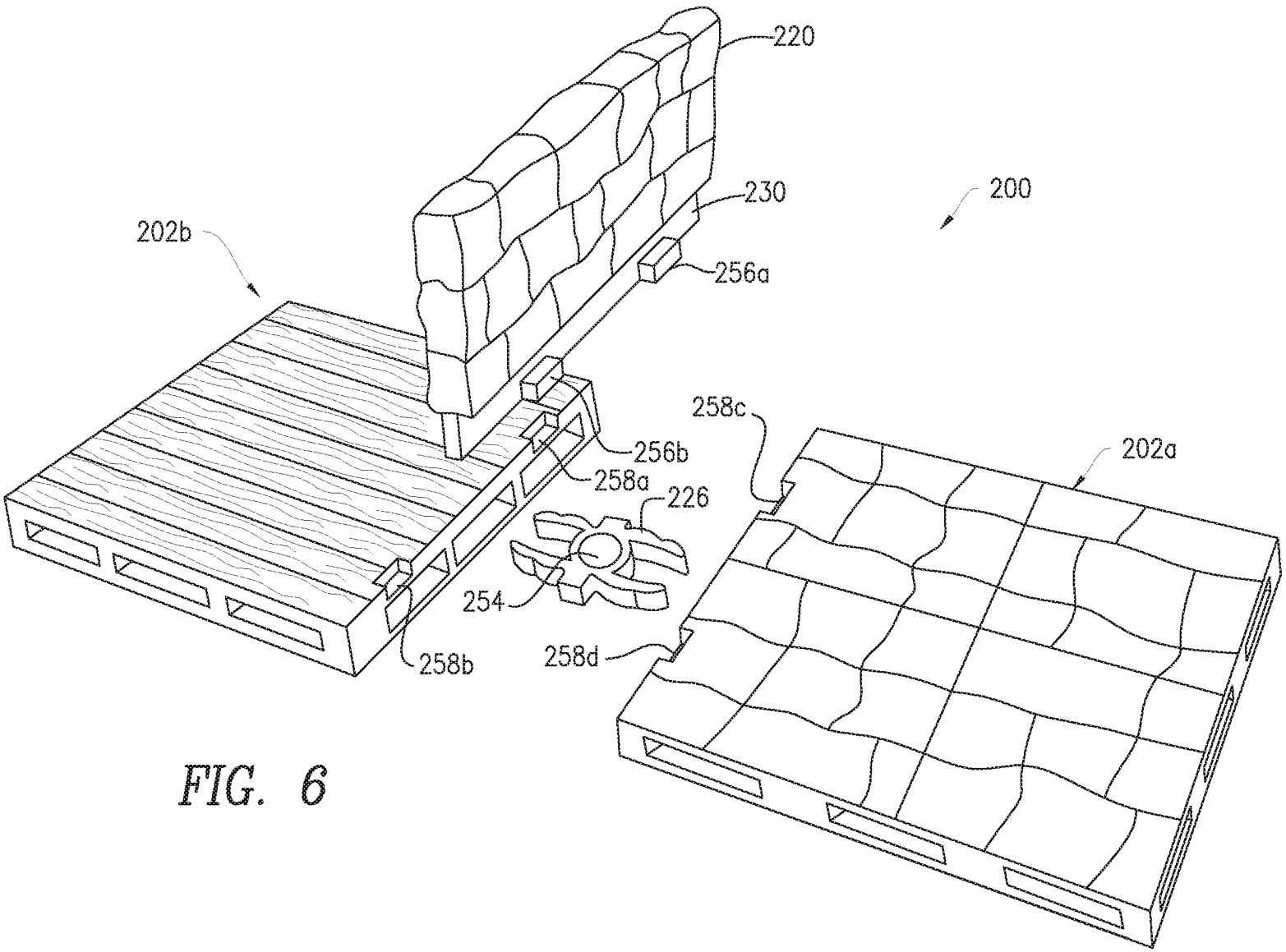
FIG. 6 is an exploded view of interior components of the tile game system, according to some aspects of the present disclosure, illustrating connections therebetween.

FIG. 6 is an exploded view of components of the tile game system 100, illustrating connections therebetween. More specifically, the components shown in FIG. 6 include a first base tile 202*a*, a second base tile 202*b*, an internal boundary 220, and a magnetized locking clip 226. As shown, the magnetized locking clip 226 can be similar to locking clip 126, described herein, with the addition of a magnet 254 disposed therein. As such, the magnetized locking clip 226 can secure the attachment of modular base tiles 202*a* and 202*b* and can secure a magnetically attractable piece 230 of the interior boundary 220. The magnetically attractable piece 230 of the interior boundary 220 can be similar to the recessed decorative section 130 of interior boundary 120, except that magnetically attractable piece 230 can be formed from a (e.g., ferrous) material that is attracted to the magnet 254.

Additionally, one or more horizontal locking tabs 256 can be provided at the base of the interior boundary 220, securing the boundary 220 to the modular base tiles 202*a* and 202*b*. For example, as shown in FIG. 6, the internal boundary 220 can include first and second horizontal locking tabs 256*a-d* (collectively, locking tabs 256) extending from the magnetically attractable piece 230 and the modular base tiles 202*a* and 202*b* can be provided with reciprocal notches 258*a-d* (collectively, notches 258) that are configured to receive the horizontal locking tabs 256 of the interior boundary 220, thereby maintaining the boundary 220 in an upright position. According to certain aspects of the present disclosure, the horizontal locking tabs 256 and the reciprocal notches 258 can be configured to frictionally engage each other and can be provided in place of, or in addition to, the magnet 254 of the magnetized locking clip 226 and the magnetically attractable piece 230 of the interior boundary 220.

According to other aspects of the present disclosure, the horizontal locking tabs 256 at the base of the interior boundary 220 can extend outward and can be configured as pressure fit dimples or nubs slotting into receptacles below the visible surface area of the modular base tiles 202. In this configuration, the design continuity of the playable square grid is maintained. According to still further aspects of the present disclosure, interior boundary 220 can be provided with one or more attachment sections, similar to attachment sections 132 of interior boundary 120, described in connection with FIG. 2.

Figure 7:
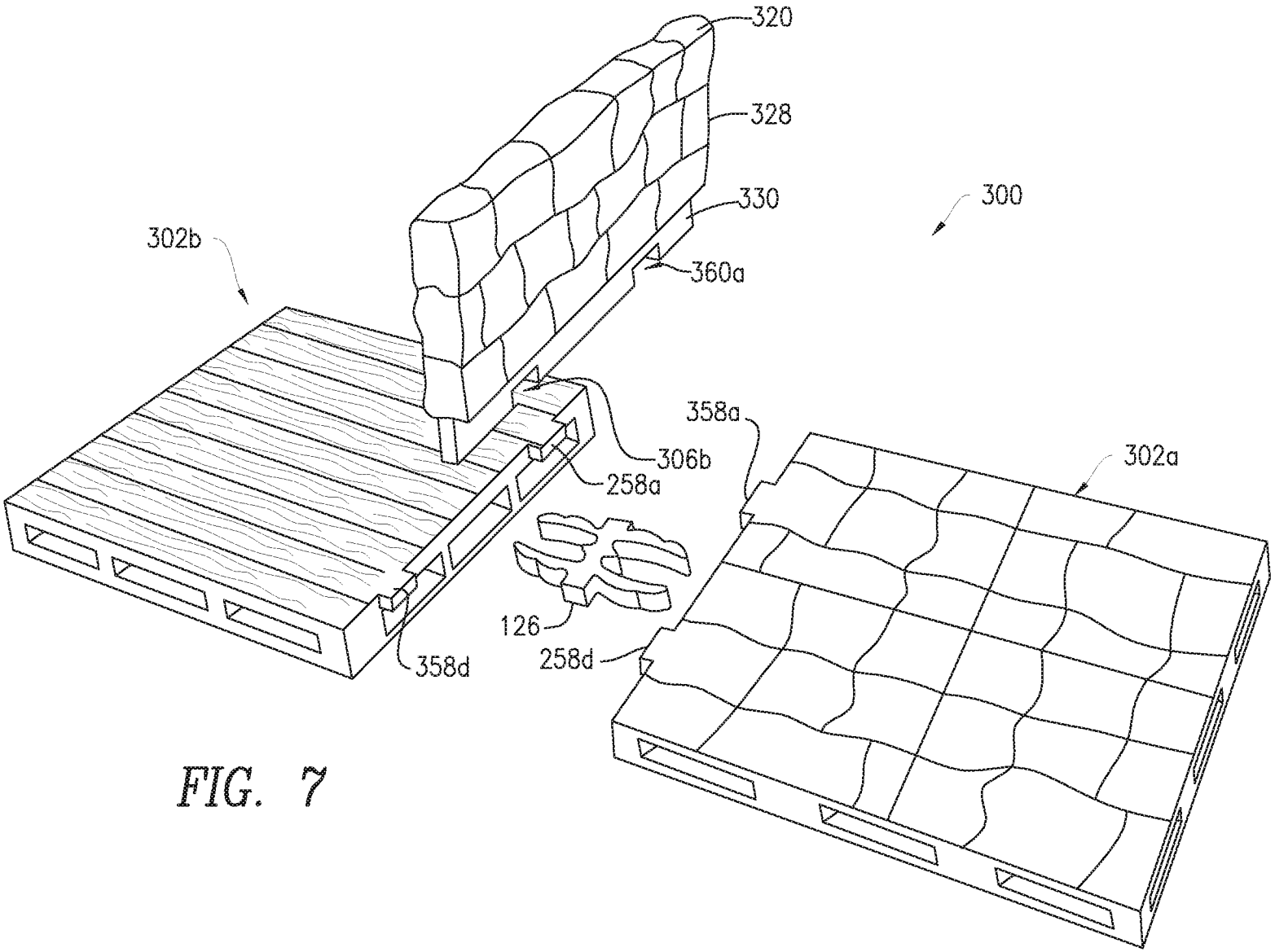
FIG. 7 is an exploded view of interior components of the tile game system, according to some aspects of the present disclosure, illustrating connections therebetween.

FIG. 7 is an exploded view of components of the tile game system 100, illustrating connections therebetween. More specifically, the components shown in FIG. 7 include a first modular base tile 302*a*, a second modular base tile 302*b*, an interior boundary 320, and a locking clip 126. As shown, modular base tiles 302*a* and 302*b* can be configured with pressure or friction fit tabs 358*a-d* supporting the interior boundary 320, configured without an attachment section (e.g., attachment sections 132), and configured as either an interior boundary of uniform thickness, for example, the thickness of the recessed decorative section 130, or as an internal boundary configured with two (2) sections, including a recessed decorative section and decorative section. For example, as shown in FIG. 7, the interior boundary 320 includes a decorative section 328 and a recessed decorative section 330. Furthermore, the recessed decorative section 330 can include notches 360*a* and 360*b*. Further still, tabs 358*a-d* and notches 360*a* and 360*b* can be configured to frictionally engage each other, thereby securing interior boundary 320 in an upright position, generally perpendicular to the modular base tiles 302*a* and 302*b*.

Accordingly, the present disclosure includes an attachment mechanism that positions a boundary (e.g., interior boundaries 120, 220, and 320) at the meeting points of (e.g., between) modular base tiles (e.g., modular base tiles 102, 202, and 302) such that the boundary refrains from infringing upon the area of a grid square (e.g., grid square 150) at any point below the height of a game figure base (e.g., base 184), as shown, for example, in FIG. 4.

Figure 8B:
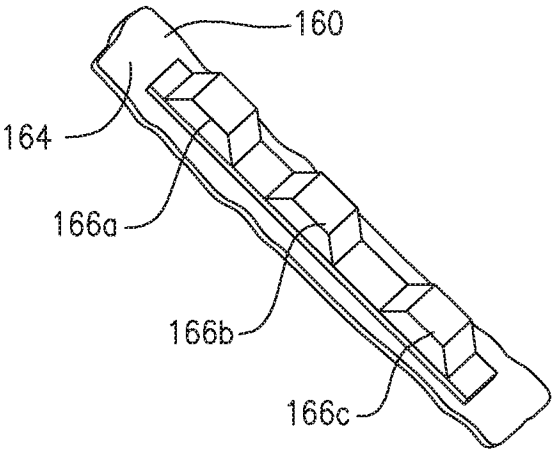
FIG. 8B is a rear perspective view of the tile veneer of FIG. 8A.
Figure 8A:
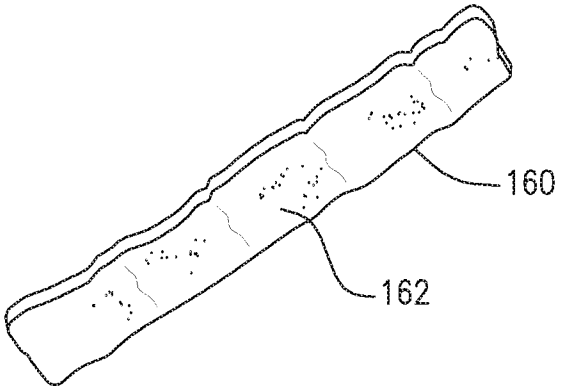
FIG. 8A is a front perspective view of a tile veneer according to the present disclosure.

FIG. 8A is a front view of a tile veneer 160 and FIG. 8B is a rear view of the tile veneer 160. The modular tiles of the present disclosure (e.g., modular base tiles 102, 202, and 302) can be provided with one or more tile veneers 160 (see FIG. 1) that can clip onto the edges of the modular base tiles, so as to conceal the attachment points normally used to insert a locking clip (e.g., clip 126). A front side 162 of these veneers 160 can include the same surface material design as the modular tiles (e.g., wood planks or stone slabs), and a rear side 164 can feature one or more protrusions 166*a-c* to pressure fit into the attachment points normally used to insert a clip 126 into the modular base tiles.

Figure 9A:
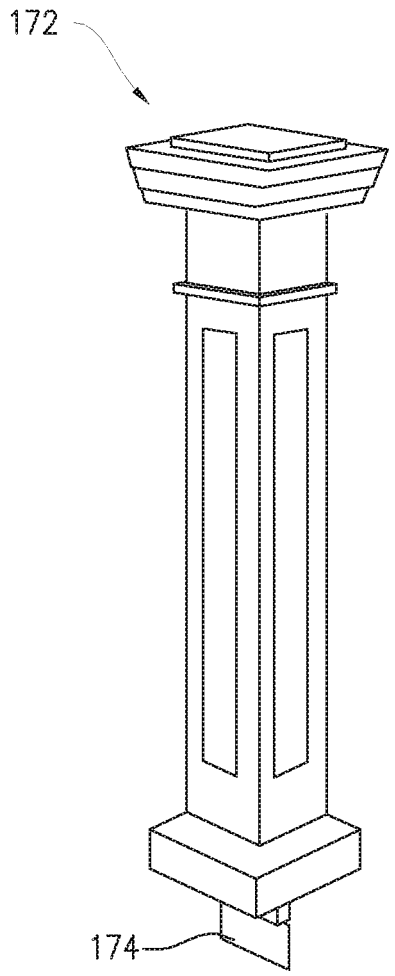
FIG. 9A is a perspective view of an interior terrain element according to the present disclosure.
Figure 9B:
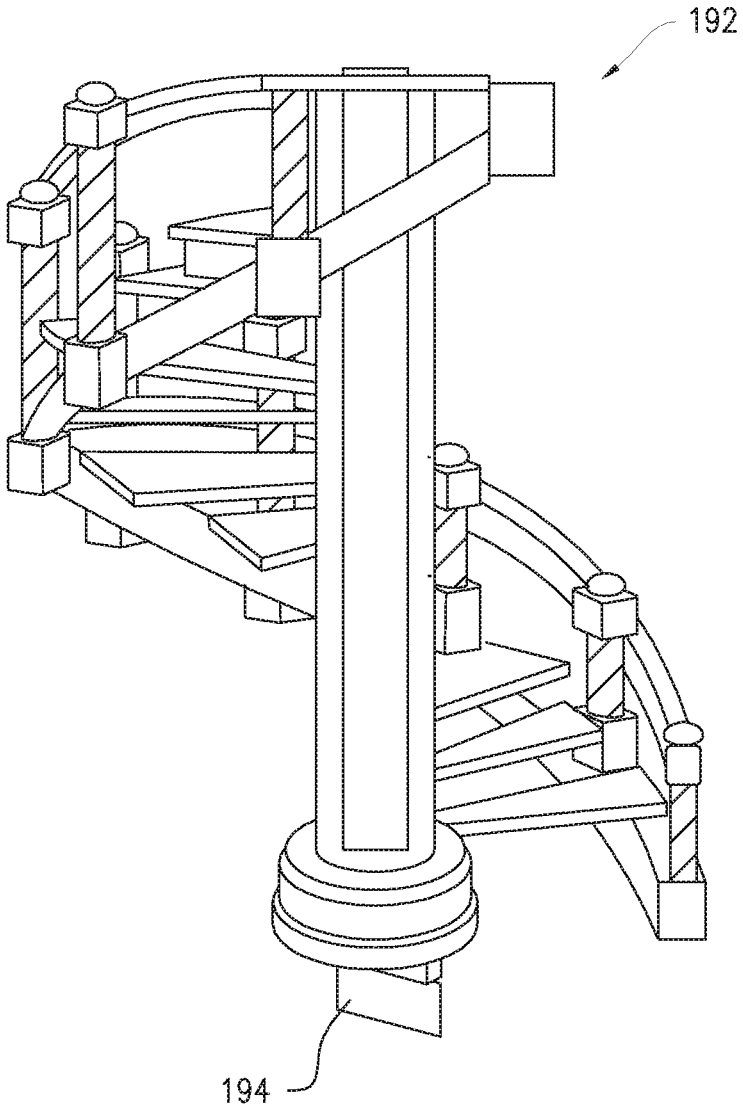
FIG. 9B is a perspective view of another interior terrain element according to the present disclosure.

According to some aspects of the present disclosure, the tile game system 100 can include one or more free-standing interior terrain elements, which can be positioned throughout the gameplay area. For example, FIG. 9A is a perspective view of an interior terrain element 172, which is configured to represent a pillar (e.g., a wood column). As shown, interior terrain element 172 can include one or more attachment sections 174, which can function similar to the attachment sections 132 of interior boundary 120. FIG. 9B is a perspective view of an interior terrain element 192, which is configured to represent a stairwell. As shown, interior terrain element 192 can also include one or more attachment sections 194, which can function similar to the attachment sections 132 of interior boundary 120. As such, one or more interior terrain elements can be positioned within the gameplay area by inserting the one or more attachment sections between adjacent tiles (e.g., modular base tiles 120). In addition to the interior terrain element 172 shown in FIG. 9A and the interior design element 192 shown in FIG. 9B, the interior terrain elements of the present disclosure can be provided in additional configurations, such as other stairwells, spiral staircases, light posts, and the like.

Figure 10:
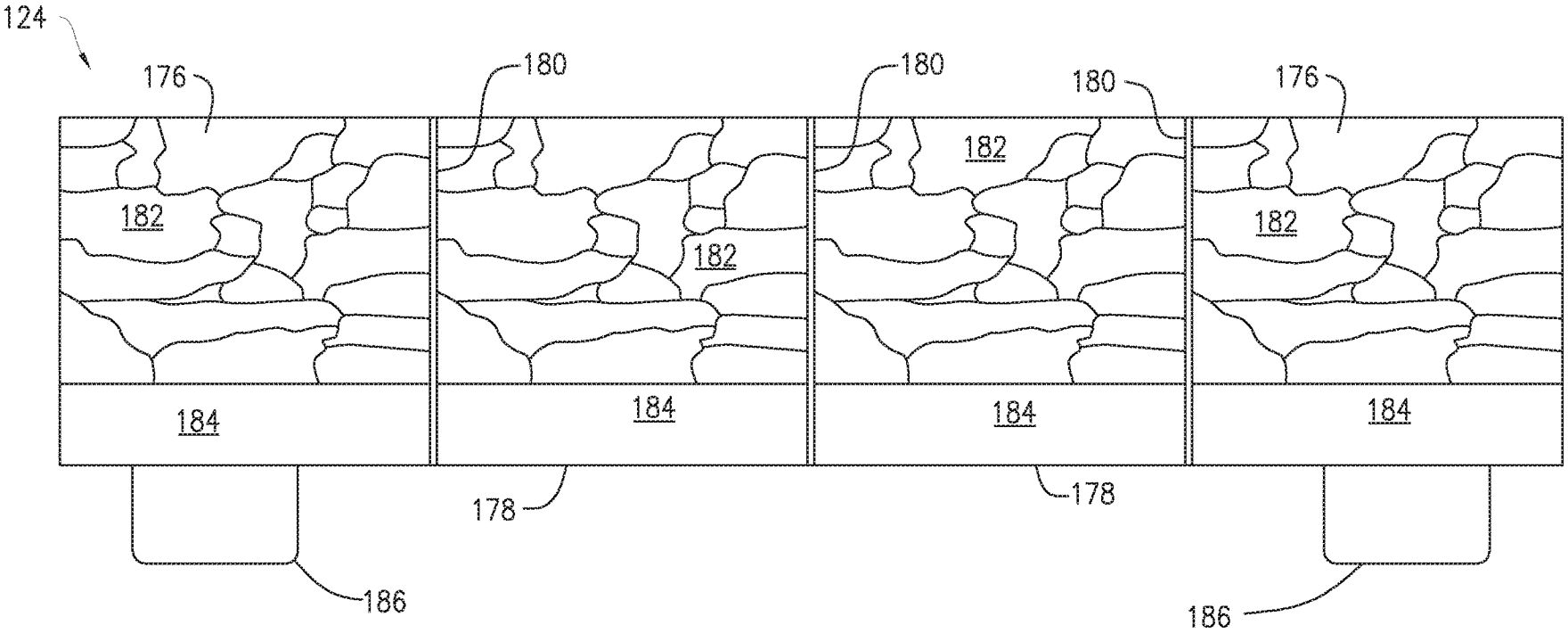
FIG. 10 is a front view of an adjustable internal boundary according to the present disclosure.
Figure 11:
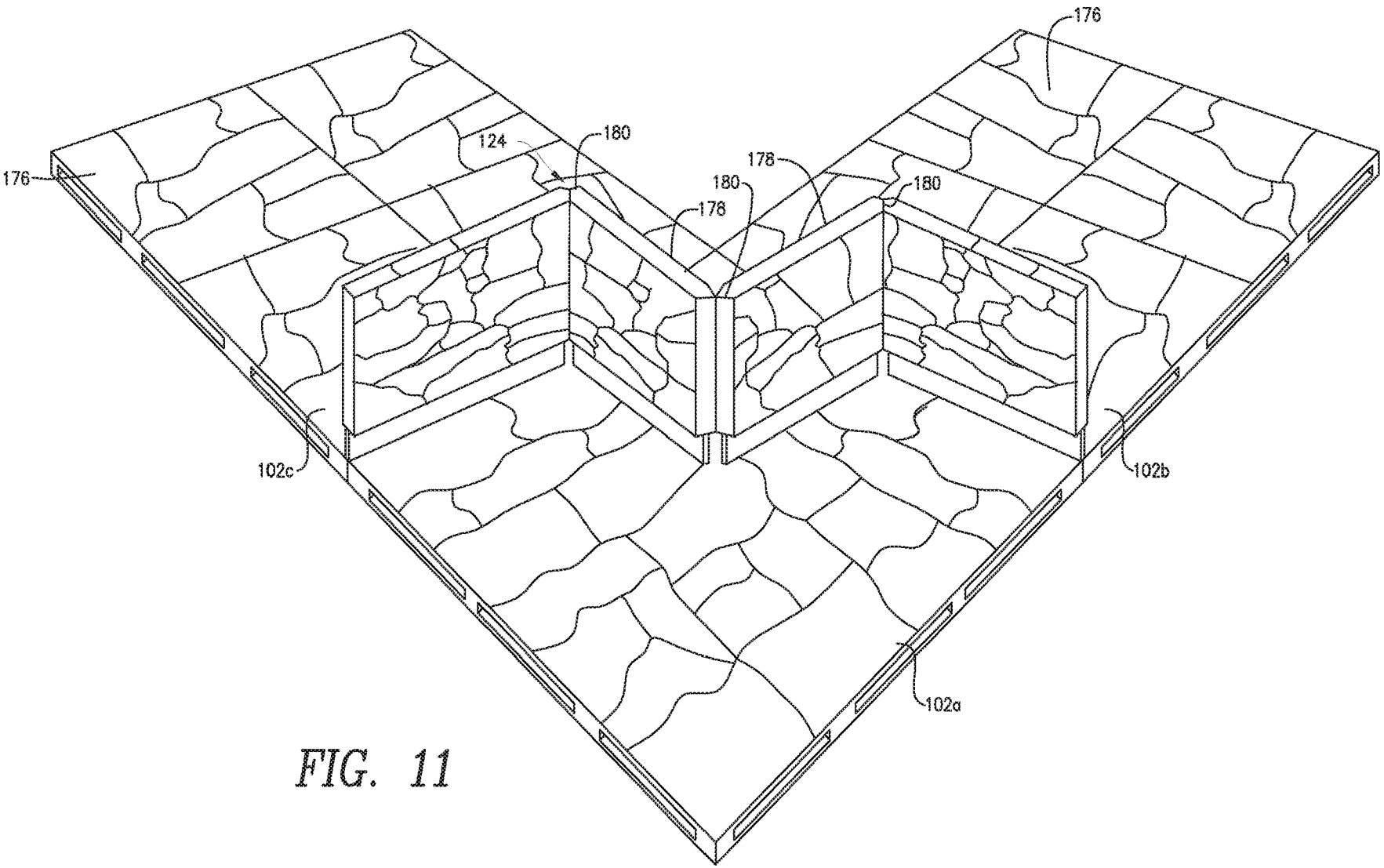
FIG. 11 is a perspective view of the adjustable internal boundary of FIG. 10, in an assembled configuration, according to the present disclosure.

FIGS. 10 and 11 illustrate an adjustable internal wall system for defining internal walls within the grid-space of a single modular base tile according to some aspects of the tile game system 100 of the present disclosure. More specifically, FIG. 10 is a front view of an adjustable internal boundary 124 and FIG. 11 is a perspective view of the adjustable internal boundary 124 positioned on the modular tiles of the present disclosure. As shown best in FIG. 10, adjustable internal boundary 124 can include one or more stabilized sections 176, one or more non-stabilized sections 178, and hinge points 180. As shown, both the stabilized sections 176 and the non-stabilized sections 178 of the adjustable internal boundary 124 can be configured with the decorative and functional characteristics of the internal boundary 120 (see, e.g., FIG. 2), including decorative sections 182, recessed decorative sections 184, and attachment sections 186. As shown, the non-stabilized sections 178 do not include an attachment section 186. Attachment sections 186 can be similar to the attachment sections 132, as discussed herein. As such, the attachment sections 186 can be, for example, rigid or partly rigid and formed from metal, plastic, composite materials, or any other suitable material for securing the adjustable internal boundary 124 to the tile game system 100 of the present disclosure.

As shown in FIG. 11, the adjustable internal boundary 124 can be configured such that the attachment sections 186 of the stabilized sections 176 are inserted between adjacent sides of the modular base tiles 102*a-c*, thereby preventing rotational motion about the attachment sections or any back and forth tipping motion along the axis defined by the length of the boundary. According to some aspects of the present disclosure, each of the stabilized sections 176 and the non-stabilized sections 178 are less than (e.g., half) the width of the internal boundary 120, such that each of the stabilized sections 176 and the non-stabilized sections 178 can have a width that is equal to the length of a single grid square unit of the tile game system 100 of the present disclosure. The hinge points 180 can connect the stabilized sections 176 and the non-stabilized sections 178 together (e.g., as a single unified piece), and allow the stabilized sections 176 and the non-stabilized sections 178 to pivot independently, for example, along a 180-degree angle of motion. As with the internal boundary 120, discussed in connection with FIG. 4, the decorative sections 182 and the recessed decorative sections 184 of the adjustable internal boundary 124 allow a game figure base 148 to occupy only an intended grid-square 150 of the tile game system 100 of the present disclosure.

According to some aspects of the present disclosure, the hinge points 180 can be a flexible material added to the exterior ends of the stabilized and non-stabilized sections 176 and 178. However, the hinge points 180 can utilize any pivoting hinge mechanism such as an injected living hinge between sections, a flexible material hinge connected internally to the ends of the sections 176 and 178, a magnetic hinge where sections 176 and 178 are connected magnetically whilst still allowing a pivoting action, a mechanical hinge, or any other existing mechanical hinge design suitable for pivotably joining sections 176 and 178 of the adjustable internal boundary 124.

As shown in FIGS. 10 and 11, the stabilized sections 176 can include a single hinge point 180 on one side thereof and a terminating standard boundary side, without a hinge point 180. Additionally, according to some aspects of the present disclosure, each stabilized section 176 can have hinge points 180 on either side thereof, allowing both sides of a stabilized section 176 to be connected to multiple non-stabilized sections 178, such that a continuing arrangement of stabilized and non-stabilized sections can extend across the tiles of the game system 100. Additionally, a non-stabilized section 178 can also be coupled to additional non-stabilized sections 178 on either side thereof. For example, the adjustable internal boundary can include two stabilized sections 176 at opposite ends thereof, with any number (e.g., one or more) of non-stabilized sections 178 therebetween, connected via hinge points 180. A benefit of multiple hinge points 180 is apparent with a game design requiring the inclusion of an interior wall that bisects a 4×4 tile 106. For example, as a 4×4 tile 106 can be single piece, with no seams (as opposed to a 4×4 area created by four (4) 2×2 modular base tiles 102), the attachment section 132 of an internal boundary 120 is not operable. As such, stabilization points via the attachment section 132 of an internal boundary 120 must occur along the perimeter of the 4×4 tile 106. Accordingly, a configuration of the adjustable internal boundary 124, including one or more stabilized sections 174 coupled to multiple non-stabilized sections 178, allows the uninterrupted flow of stabilized internal boundaries 124 across any size tile area.

Figure 12:
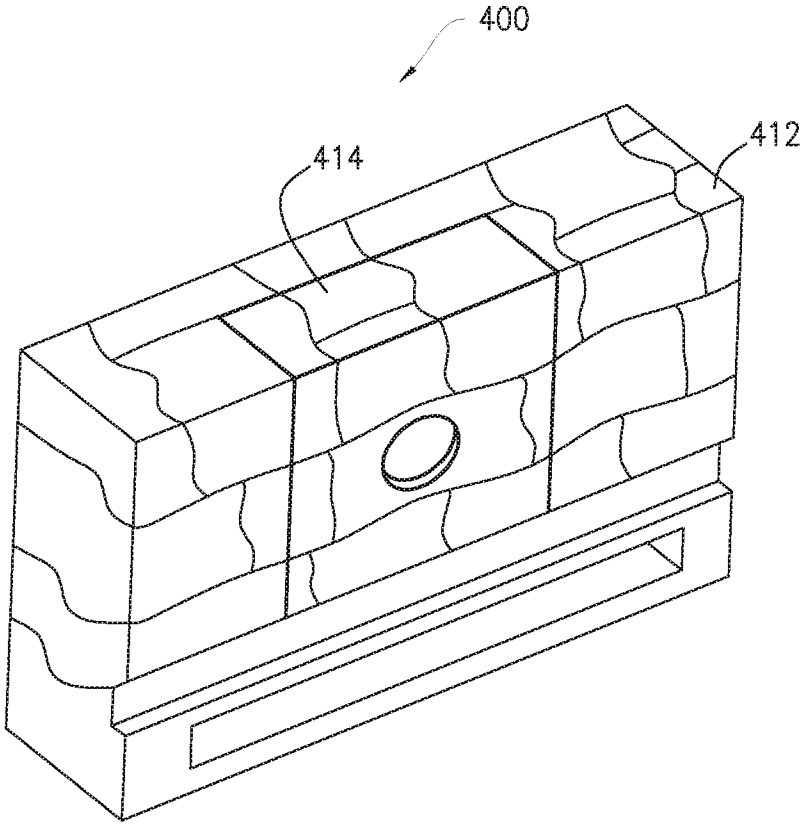
FIG. 12 is a perspective view of an illuminated external boundary, positioned in a first configuration, according to some aspects of the present disclosure.
Figure 13:
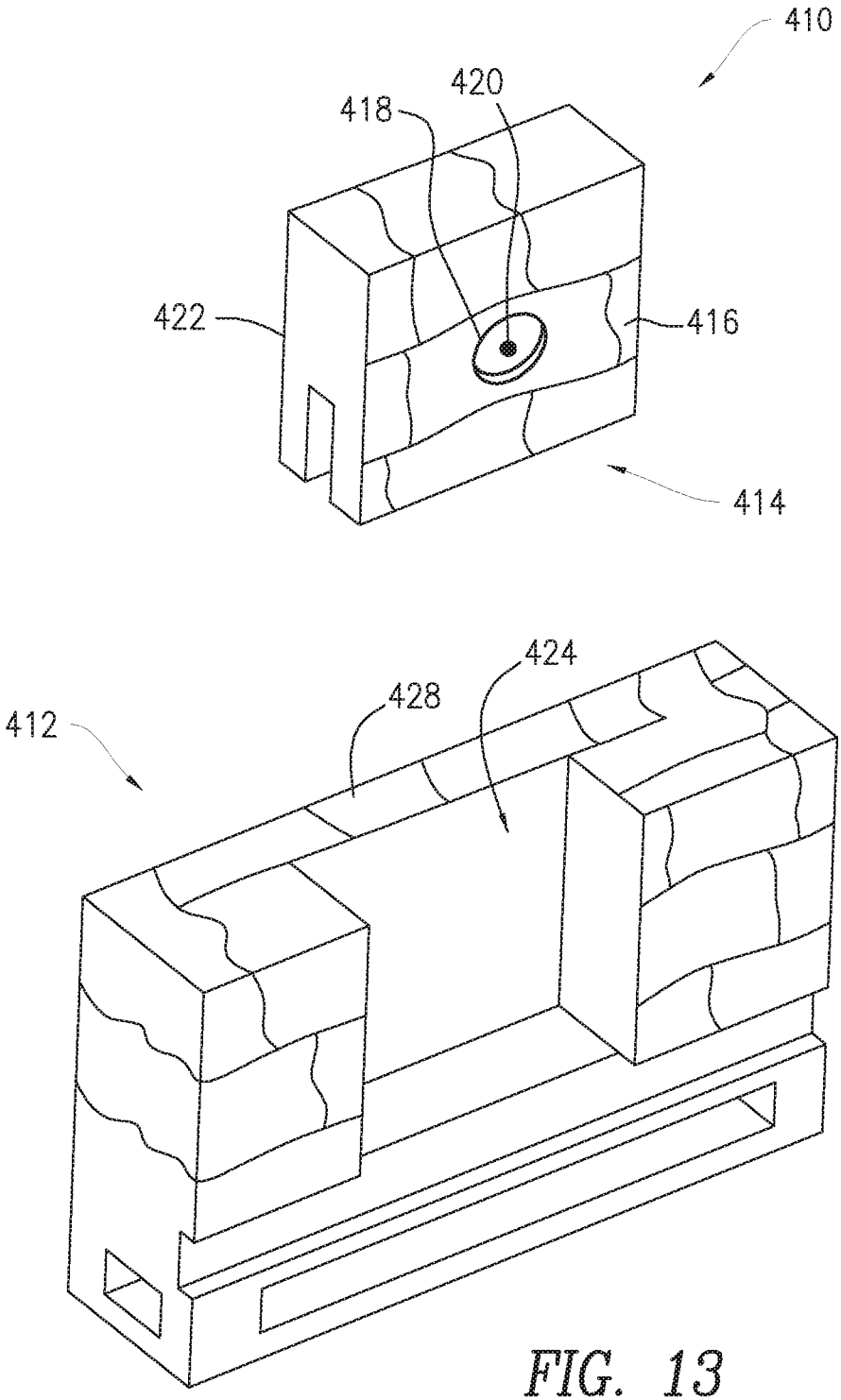
FIG. 13 is an exploded view of the illuminated external boundary of FIG. 12.
Figure 14:
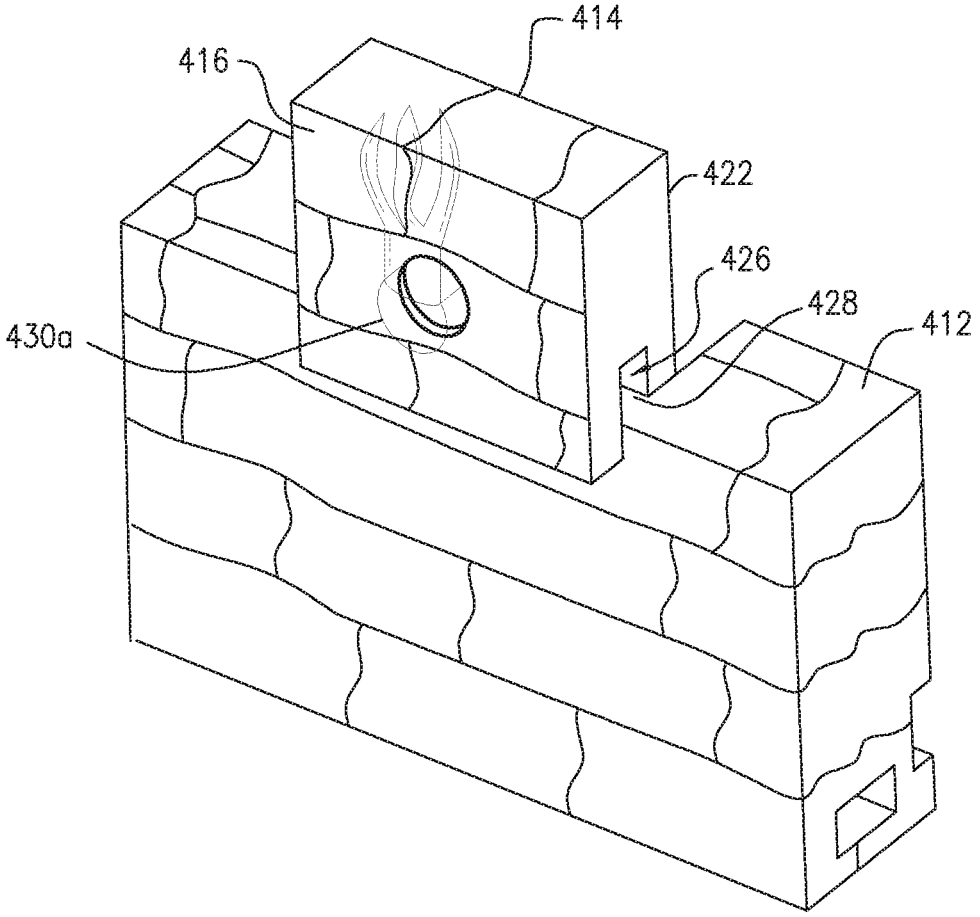
FIG. 14 is a perspective view of the illuminated external boundary of FIG. 12, positioned in a second configuration.
Figure 15:
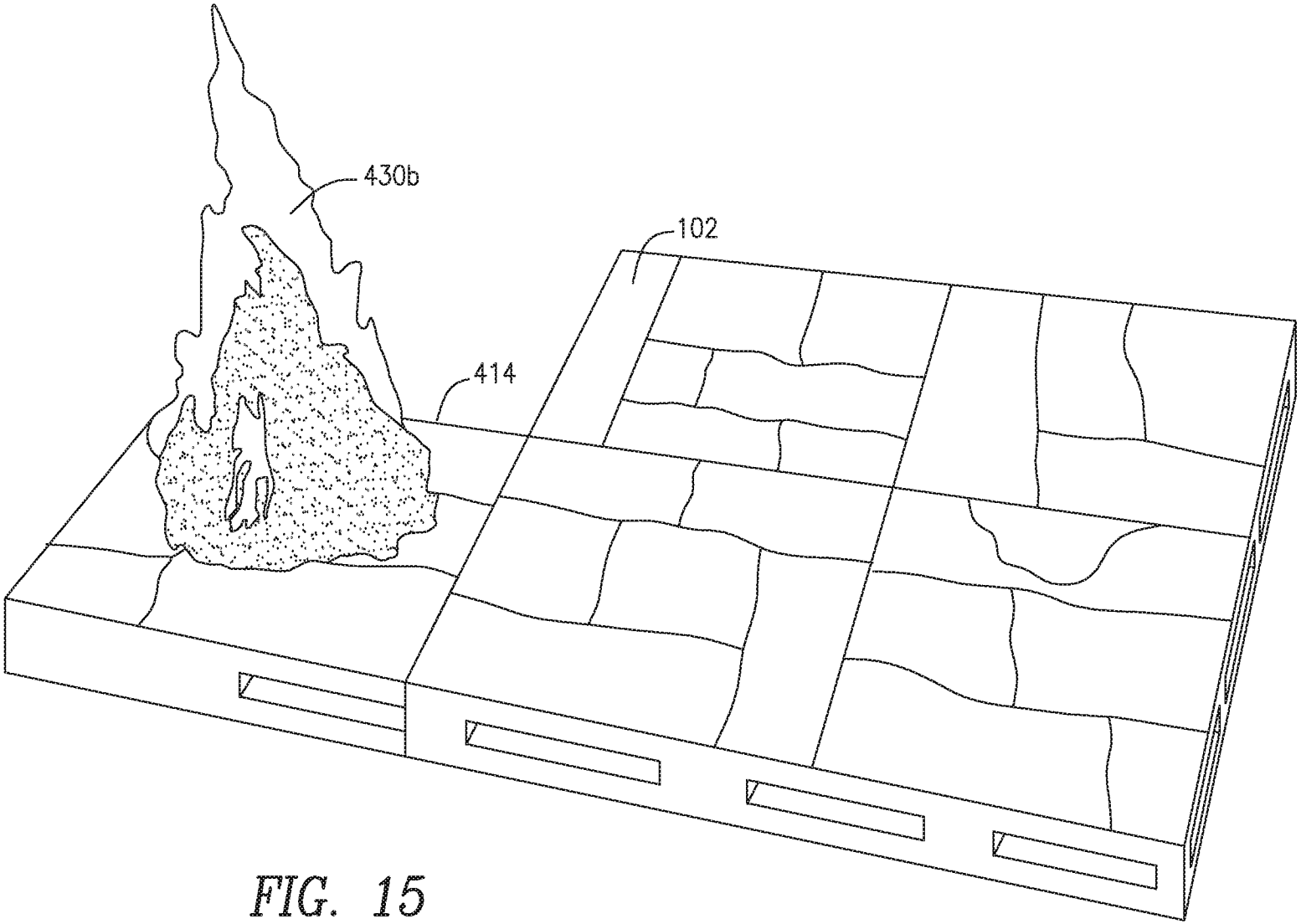
FIG. 15 is a perspective view of an illuminated tile section of the illuminated external boundary of FIG. 12, positioned in a third configuration, according to some aspects of the present disclosure.

FIGS. 12-15 illustrate an external boundary with lighting 410, according to some aspects of the present disclosure. More specifically, FIG. 12 is a perspective view of the external boundary with lighting 410 arranged in a first (e.g., docked) configuration, FIG. 13 is an exploded view of the external boundary with lighting 410, FIG. 14 is a perspective view of the external boundary with lighting 410 arranged in a second configuration, and FIG. 15 is a perspective view of the external boundary with lighting 410 arranged in a third configuration. As shown in FIGS. 12-15, the external boundary with lighting can be arranged in multiple configurations for lighting the tile game system 100 of the present disclosure. The external boundary with lighting 410 can include a docking section 412 and a separated lighted tile segment 414 having a front face 416 with an receptacle 418 that exposes a light source 420, and a back face 422 with a control opening (not shown) for manipulating led operation. As shown in FIG. 12, the lighted tile segment 414 can be seated within a recessed area 424 in docking section 412. According to some aspects of the present disclosure, the external boundary with lighting 410 can be configured to have the have the same exterior dimensions as the external boundary 110.

As shown in FIG. 14, the external boundary with lighting 410 can be configured such that the lighted tile segment 414 can be seated on top of the docking section 412. More specifically, the lighted tile segment 414 can include a channel 426 (or other clip system) created between the front face 416 and the back face 422 of the lighted tile segment 414, which can be sized to clip onto (e.g., positioned on, via friction fit or the like) a rear wall 428 of the external boundary with lighting 410

The lighted tile segment 414 can also be provided with a light transmitting element 430 that depicts a light emitting source, for example, a torch. The light transmitting element 430 can be formed from any material that allows light from the light source 420 to pass therethrough and can include a (e.g., cylindrical, plug-like) protrusion extending from a back surface thereof. The protrusion can be configured to be received by, and mate with, the receptacle 418 of the lighted tile segment 414. The light transmitting element 430 can be shaped to represent any light emitting source and can be formed from any material that can be illuminated via the protrusion. The protrusion can be integrally formed with the light transmitting element 430, or formed as a separate component, and can serve the dual purpose of acting as a conduit for light, and as friction fitting into the receptacle 418 of the lighted tile segment 414. The light transmitting element 430 can be formed to represent, but is not limited to, a miniature sign or engraving, a facial model such as a skull or mask, a figure, or some effect particular to the space, such as fire or energy.

According to some aspects of the present disclosure, the lighted tile segment 414, utilizing the channel clip system described above (e.g., channel 426), can be seated on an internal boundary 120. For example, the thickness of the internal boundary 120 and the thickness of the rear wall 428 of the docking section 412 (e.g., the remaining thin wall of the external boundary with lighting 410 after the lighted tile segment 414 is removed) can be configured to be approximately equal. Likewise, the width of the channel 426 of the lighted tile segment 414 can be configured to accept both the rear wall 428 of the docking section 412 and the internal boundary 120. Furthermore, the width of the channel 426 of the lighted tile segment 414 can also be configured to clip on to, and to accept, both the stabilized sections 176 and the non-stabilized sections 178 of the adjustable internal boundary 124.

As shown in FIG. 15, the lighted tile segment 414 of the external boundary with lighting 410 can be joined with one or more modular tiles of the tile game system 100. For example, the lighted tile segment 414 can have an external length and width that are approximately equal to one (1) grid-square 150 unit length of a modular tile (e.g., tile 102, 104, or 106) of the tile game system 100 and the lighted tile segment 414 can have a depth (defined as the distance between the front face 416 and the back face 422) that can be approximately equal to the depth of a modular base tile (e.g., modular base tile 102), where the depth of the modular base tile is the distance from the top of the pattern on one side of the tile to the top of the pattern on the opposing side of the tile.

The lighted tile segment 414 can be provided with a light transmitting element 430*b*. For example, the light transmitting element 430*b* can be a scaled model of a light emitting source, such as a ground based fire shown in FIG. 15. The light transmitting element 430*b* can rest on the receptacle 418 of the lighted tile segment 414, and when the light source 420 is activated, the miniature model illuminates accordingly. According to other aspects of the present disclosure, a miniature model of a light emitting source (e.g., light transmitting element 430*b*) can also be configured with a protrusion such that it mates with the receptacle 418. The light transmitting element 430*b* can be anything intended to illuminate via a protrusion, which can serve the dual purpose of acting as a conduit for light and as a friction fitting into the receptacle 418. For example, the light transmitting element 430*b* can be formed to represent, but is not limited to, a miniature sign or engraving, a figure, a light post or some atmosphere effect particular to the space, such a fire or energy. According to some aspects of the present disclosure, the lighted tile segment 414 can include a protrusion configured as a connective means to the receptacle 418 for light transmittable piping to illuminate a game figure, or the like.

According to other aspects of the present disclosure, multiple units of the lighted tile segment 414 can be joined together (e.g., via locking clips 126) to form a larger game tile, for example, a 2×2 grid-square modular base tile 102. Also, a complementary modular base tile can be provided that, when combined with one or more lighted tile segments 414, can form a complete modular tile (e.g., 2×2 unit grid-square). For example, where only a single lighted tile segment 414 is provided, the complementary modular base tile can be "V" shaped, composed of three single grid squares arranged in a 90-degree pattern. According to another example, where two (2) adjacent lighted tile segments 414 are provided, the complementary modular base tile to complete the 2×2 four unit grid-square can be a 2×1 modular base tile.

Figure 16:
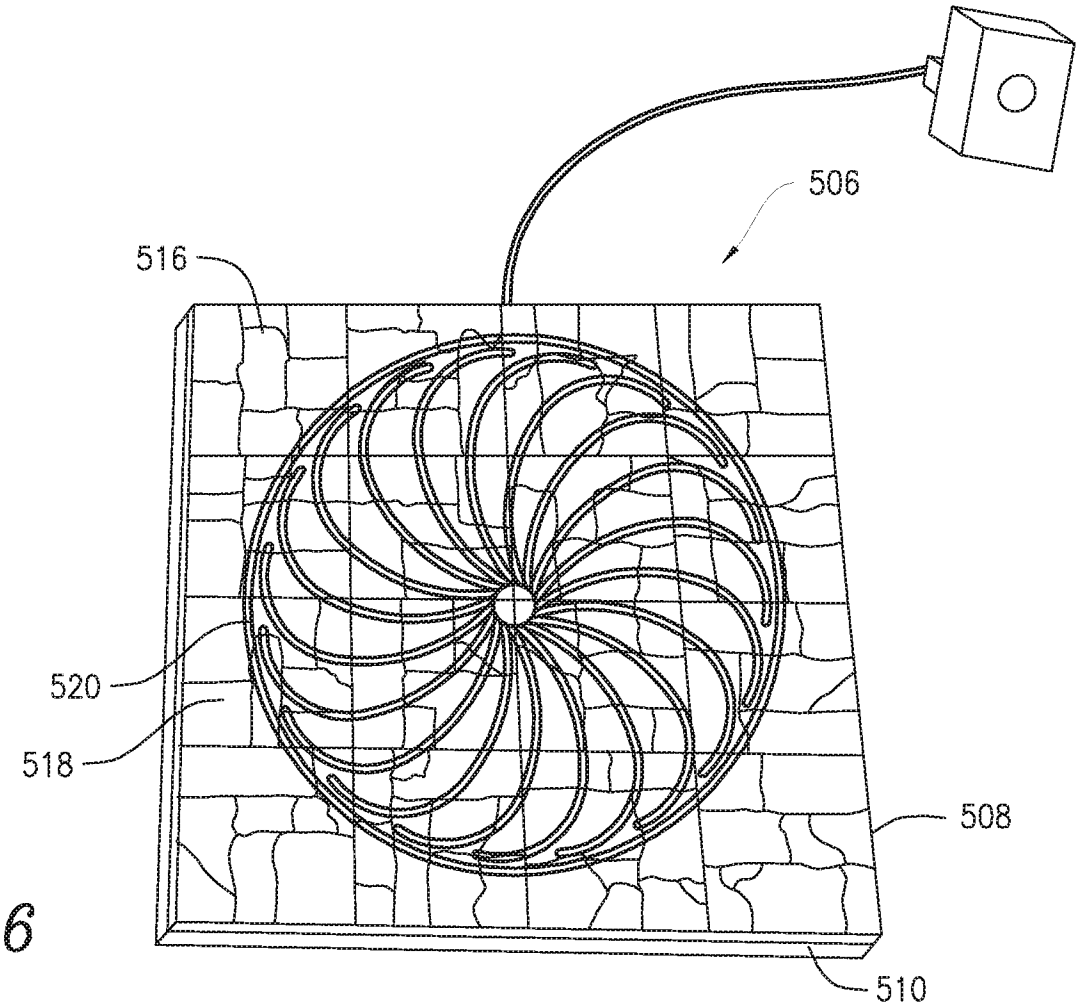
FIG. 16 is a perspective view of an illuminated tile unit according to some aspects of the present disclosure.
Figure 17:
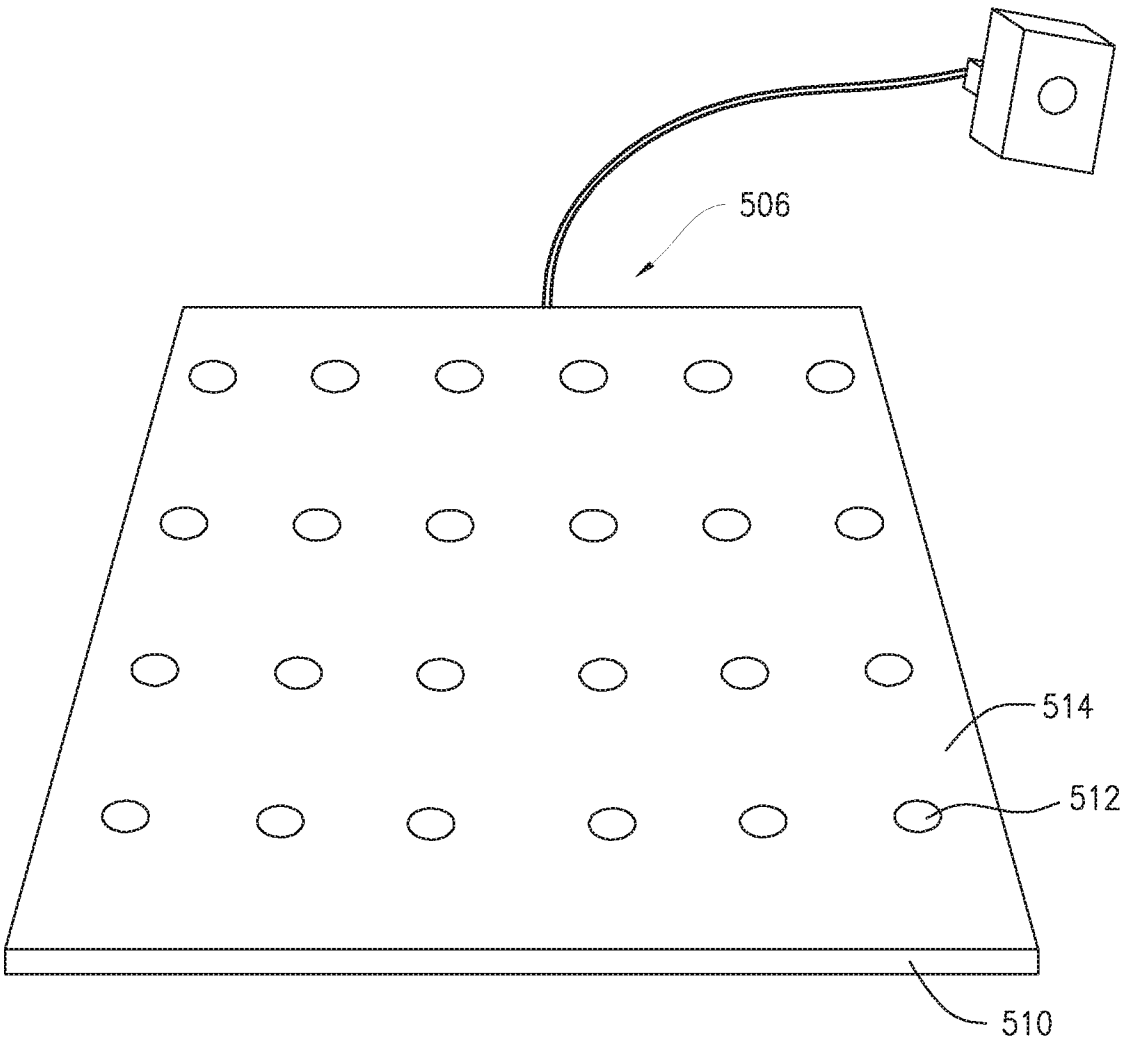
FIG. 17 is a perspective view of the illuminated tile unit of FIG. 16, with a light permeable skin removed.

FIGS. 16 and 17 are perspective views of an illuminated tile unit 506 having a replaceable light permeable decorative skin 508. More specifically, FIG. 16 shows the illuminated tile unit 506 with the replaceable light permeable decorative skin 508 arranged thereon and FIG. 17 shows the illuminated tile unit 506 with the replaceable light permeable decorative skin removed.

As shown in FIG. 17, the illuminated tile unit 506 can be configured as a 4×4 grid-square unit having an illuminating function—whether by LED, incandescent, electroluminescent or some other light transmitting means, whereby light is transmitted upwards. For example, the illuminated tile unit 506 can include a base having one or more (e.g., an array of) LED lights. Furthermore, the illuminated tile unit 506 can include a pressure-activated light function (e.g., via a switch or button) whereby light operations, such as ON and OFF, and light settings, such as color, brightness, and effects (e.g., fade, blink, pulse, etc.), can be accessed by downward pressure applied to an illuminating face 514 of the illuminated tile unit 506.

As shown in FIG. 16, the light permeable decorative skin 508 can include a decorative side 516 including an opaque skin area 518 that prevents the transmission of light and a light permeable skin area 520 that permits the transmission of light. The light permeable decorative skin 508 can also include a translucent skin area that allows for the transmission of light subject to the characteristics of the material of which light permeable decorative skin 508 is composed.

The depth of the illuminated tile unit 506, including both the replaceable light permeable decorative skin 508 and base 510, can be approximately equal to the depth of a modular base tile (e.g., tile 102, 104, or 106). For example, if the depth of modular base tile 102 is 8 mm and the base 510 of the illuminated tile unit 506 is 6 mm, then the light permeable decorative skin 508 can be 2 mm. Conversely, if the light permeable decorative skin 508 is 6 mm, then the base 510 of the illuminated tile unit 506 can be approximately 2 mm.

According to other aspects of the present disclosure, the light permeable decorative skin 508, whilst maintaining the above defined light transmitting characteristics, can be voluminous, exhibiting physical protrusions upward that can emulate natural terrain formations such as rocks, boulders, lava flows, water flows, pools, vegetation, etc. and built terrain formations such as ruins, architecture, and other non-naturally occurring voluminous formations.

Furthermore, while an exemplary configuration of the illuminated tile unit 506 is shown in FIGS. 16 and 17 as a 4×4 size illuminated tile 506 including a 4×4 size light permeable decorative skin 508, other shapes and sizes such as a 1×1, 2×2, 3×3, 5×5, etc., or any irregularly shaped tile including, but not limited to, a 2×3, 2×4, "V" shaped 3×1, etc. are included within the scope of the present disclosure.

Additionally, as shown in FIGS. 16 and 17, the illuminated tile unit 506 can be coupled to an external power source 522 for powering the illuminated tile unit 506 (e.g., providing power to the one or more LED lights 512). Additionally, or alternatively, the illuminated tile unit 506 can also include an internal power source (e.g., one or more batteries) driving the illuminating function, making the illuminated tile 506, a self-contained unit.

The tile game system 100 of the present disclosure can include a plurality of light permeable decorative skins 508, with different types of illuminating patterns. Furthermore, a first light permeable decorative skin 508 can be removed from the base 510 of the illuminated tile unit 506 and replaced with a second light permeable decorative skin having a different illuminating pattern, such that consumers have the ability to utilize a plurality of different replaceable light-permeable decorative skins 508, without requiring replacement of the base 510 of the illuminated tile unit 506, and thereby enjoying the light-transmitting functionality, while limiting the consumer cost associated with the investment in light-emitting technology in the base 510 of the illuminated tile unit 506 of the tile game system 100.

According to other aspects of the present disclosure, the illuminated tile 506 and replaceable light-permeable decorative skin 508 can be configured in a 2×2 grid-unit square format and provided in a multiplicity. These 2×2 illuminated tile units (and illuminated tile units 506) can furthermore be configured such that the multiplicity of units can be remotely controlled by a separate control unit, whether by RF, Bluetooth, Wi-Fi, IR, or other remote control technology that has the ability of actuating synchronized light function change on the multiplicity of illuminated tile units.

According to some aspects of the present disclosure, the illuminated tile units 506 can be placed in an adjacent position to each other, for example, either side to side, or corner to corner, in a meandering or directed pattern, within the tile game system 100. For example, a plurality of paired replaceable light-permeable decorative skin pieces 508 can be configured with decorative side 516 designs representative of a unified path of flow. This unified path of flow can be presented as naturally occurring flows, including but not limited to, lava flows, water flows, and in the world of fantasy, energy flows, fire flow, ice flows, electricity flows, stone path flows, crystal flows, organic matter flows, and the like. These flows can also be presented as non-natural occurring flows, including but not limited to, built pathways or architectures represented as stone, masonry, steel or other built items of a modern, futuristic, fantastic, or ancient styles.

Furthermore, each of the illuminated tile units 506 can be controlled, separately or together, by one or more controllers, such that an effect of flow can be attained among the plurality of units comprising the unified path flow. As an example, where the plurality illuminated tile units 506 and the replaceable light-permeable decorative skin pieces 508 are configured to represent a stream or river, a prescribed light operation can toggle light-emission between light blue, blue, and dark blue. This random oscillation of hues of blue amongst the plurality of replaceable light-permeable decorative skin units 508 can provide the illusion of flowing water.

Figure 18:
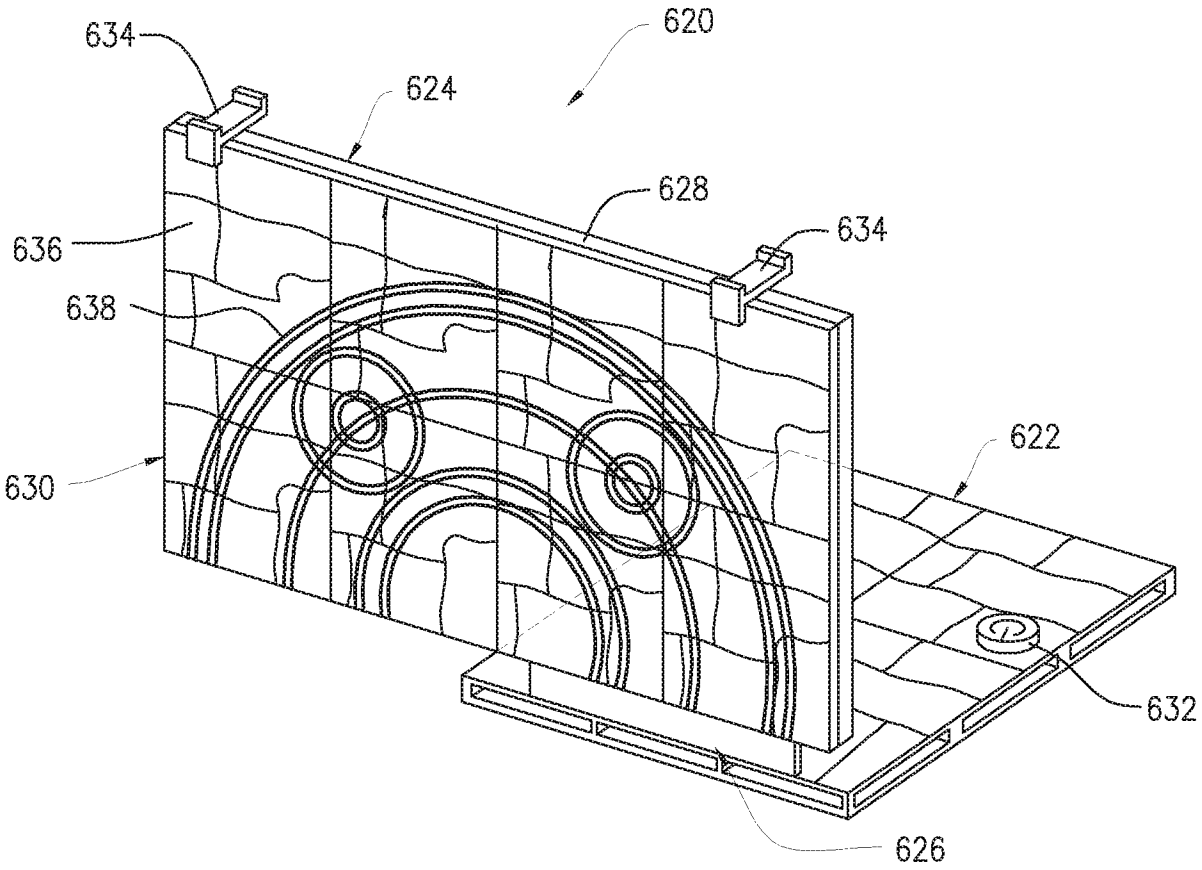
FIG. 18 is a perspective view of an illuminated internal boundary according to some aspects of the present disclosure.

FIG. 18 is a perspective view of an illuminated internal boundary 620 including a base tile portion 622 and a vertical wall 624. As shown, the vertical wall 624 can be coupled to an edge of the base tile 622 and extend upward at a generally perpendicular angle thereto, such that the vertical wall 624 can be positioned between the base tile 622 and an adjacent tile (e.g., tiles 102, 104, or 106) Similar to interior boundary 120, the illuminated internal boundary 620 can include a recessed section 626 at the bottom of the vertical wall 624, allowing for a base 148 of a game FIG. 108 (see FIG. 4) to extend therein and preventing the base 148 of the game figure from extending onto one or more adjacent grid squares 150.

The vertical wall 624 of the of the illuminated internal boundary 620 can include a backlight 628 and a light permeable skin 630. The backlight can be formed from a light-transmissive and/or scattering material and can include a light source (e.g., LED edge-lighting) that projects light in one or more directions (e.g., perpendicular to each vertical side of the backlight 628). Additionally, the light source of the backlight 628 can be coupled to an external power source, or a power source (e.g., a battery) can be positioned within the base tile 622. Furthermore, the base tile 622 can include a button 632, or the like for controlling operation of the backlight 628. For example, similar to the illuminated tile unit 506, the backlight 628 can be configured with a plurality of programs, such as for varying the colors and patterns of the light produced by the light source.

As shown in FIG. 18, the light permeable skin 630 can be positioned directly adjacent to, and cover, the backlight 628, such that the backlight is not visible when viewed from a direction normal thereto. The light permeable skin 630 can be removably attached to the backlight 628 (e.g., via clips 634 or the like) and a light permeable skin 630 can be positioned on either side of the backlight 628. The light permeable skin 630 can be substantially similar in form and function to the light permeable decorative skin 508, and thus, can include an opaque skin area 636 and a light permeable skin area 638, allowing light from the backlight 628 to pass therethrough in a predetermined pattern. According to other aspects of the present disclosure, the illuminated internal boundary 620 can be configured to have a generally similar form to internal boundary 120. Specifically, the vertical wall 624 if the illuminated internal boundary 620 can include a power source for powering the backlight 628 and a button 632, or the like, for controlling operation thereof, and therefore does not need to be coupled to the base tile 622.

Figure 19:
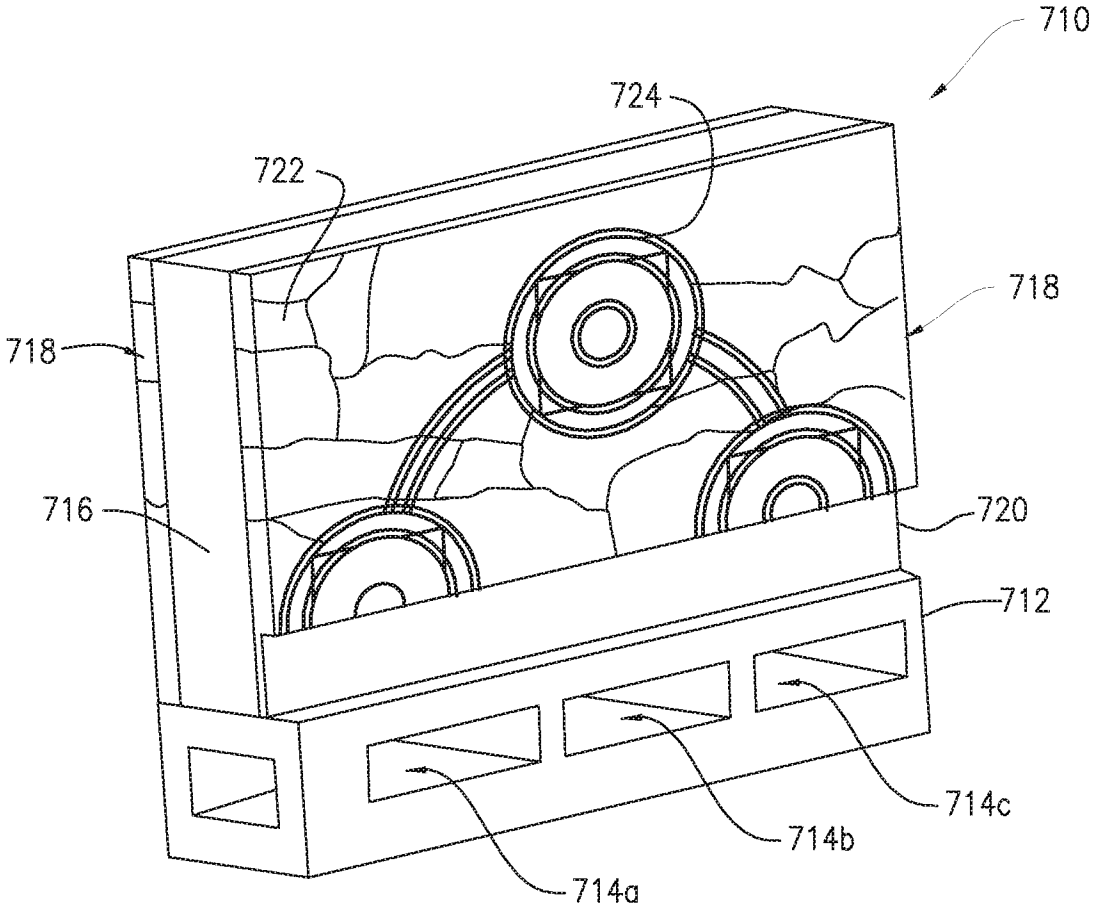
FIG. 19 is a perspective view of an illuminated external boundary according to some aspects of the present disclosure.

FIG. 19 is a perspective view of an illuminated external boundary 710 of the tile game system 100 of the present disclosure. Illuminated external boundary 710 can be substantially similar in form as the external boundary 110 and substantially similar in function as the illuminated internal boundary 620, except for the distinctions noted herein. As shown, the illuminated external boundary 710 can include a base 712 with one or more apertures 714 (e.g., apertures 714*a-c*) configured to accept a locking clip 126 for attachment to one or more adjacent tiles (e.g., tiles 102, 104, 106, or any illuminated tile or segment disclosed herein), a vertical backlight 716 extending generally perpendicular from the base 712, and one or more light permeable skins 718 removably attached to one, or both, sides of the backlight 716. The light permeable skin 718 can be substantially similar in form and function to the light permeable decorative skin 508, and thus, can include an opaque skin area 722 and a light permeable skin area 724, allowing light from the backlight 716 to pass therethrough in a predetermined pattern. Similar to exterior boundary 110, illuminated external boundary 710 can include a recessed section 720, allowing for a base 148 of a game FIG. 108 (see FIG. 4) to extend therein and preventing the base 148 of the game FIG. 108 from extending onto one or more adjacent grid squares 150. Like the illuminated internal boundary 620, the illuminated external boundary can be coupled to an external power source, or include a power source therein (e.g., a battery), for providing power to the backlight and can include a button or switch for controlling operation thereof.

Figure 20:
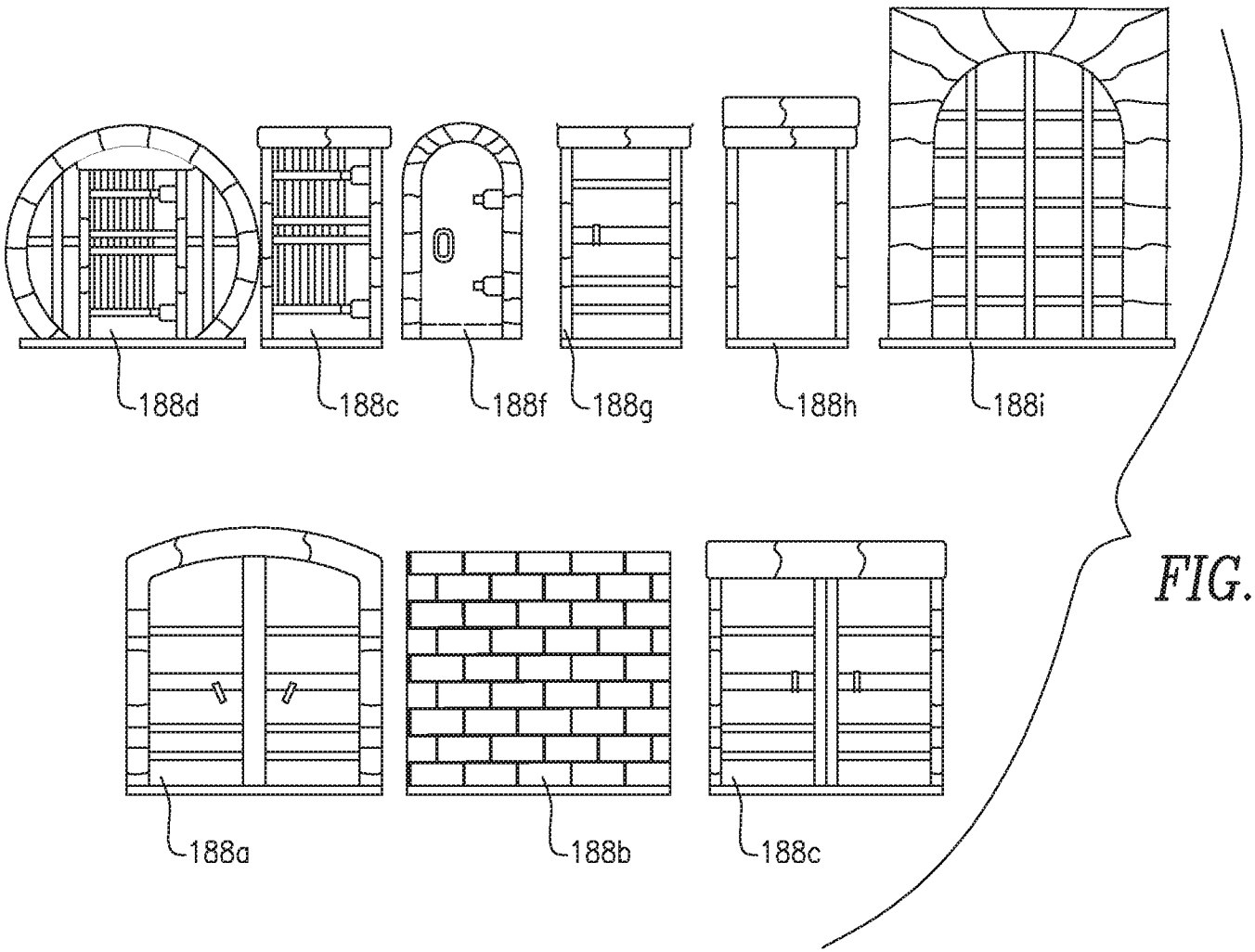
FIG. 20 illustrates a plurality of game components according to some aspects of the present disclosure.
Figure 21:
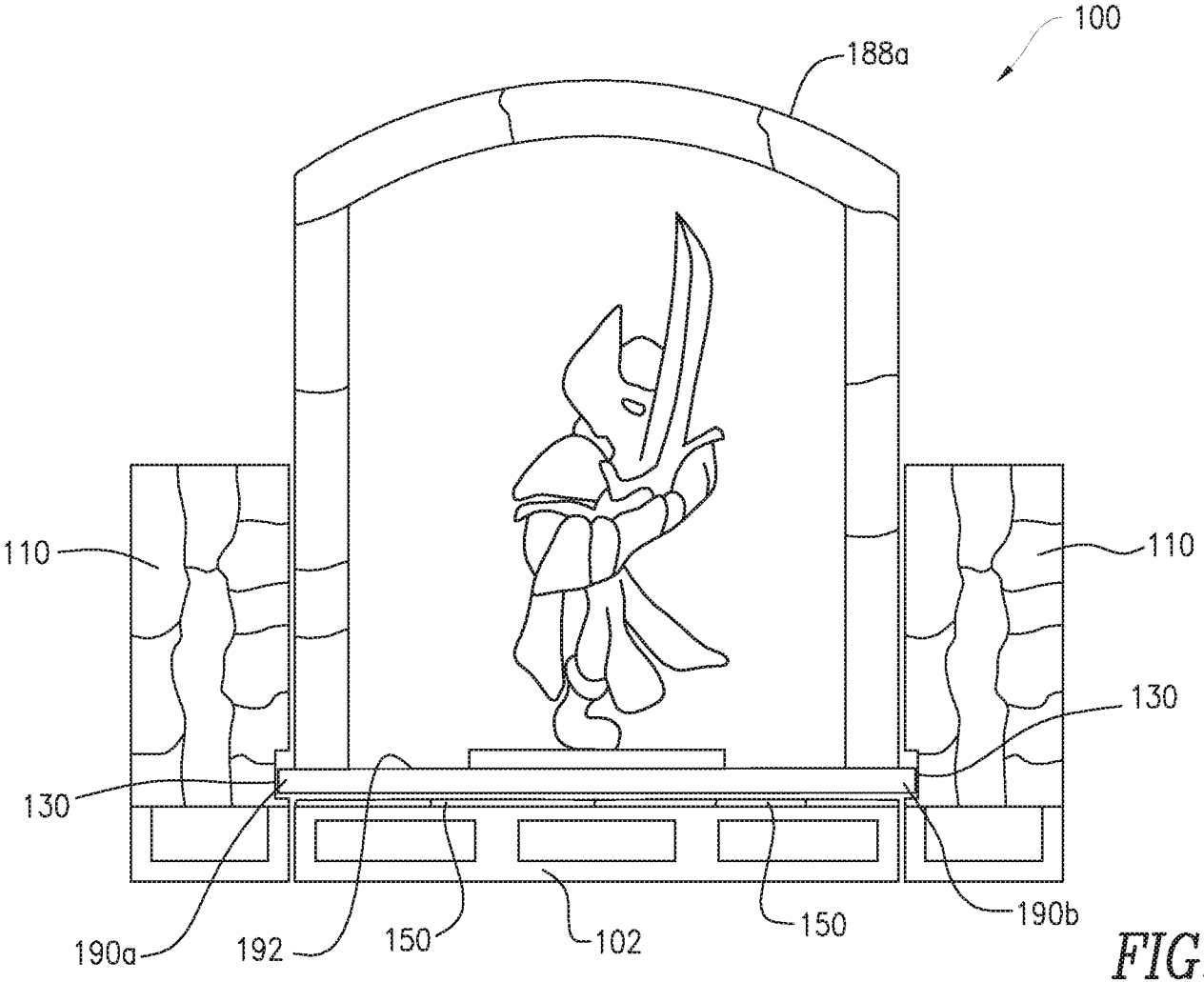
FIG. 21 illustrates a game component of FIG. 20 positioned within the tile game system of the present disclosure.

FIG. 20 shows a plurality of game components 188*a-i* of the tile game system 100 according to some aspects of the present disclosure and FIG. 21 shows the game component 188*a* positioned within the tile game system 100 of the present disclosure. As shown, each of the game components 188*a-i* can be configured to be positioned on top surfaces of the modular base tiles (e.g., tiles 102, 104, and 106) of the system 100. Furthermore, each of the game components 188*a-i* can be configured to have a with that is substantially equal to one or more grid squares 150 of the modular base tiles. For example, as shown in FIG. 21, game component 188*a* has a width that is approximately equal to the width of the modular game tile 102 (e.g., the width of two grid squares 150), with outermost edges 190*a* and 190*b* of a base 192 of the game component 188*a* being received within the recessed sections 130 of the external boundaries 110. The game components can also have a with less than, or greater than, that of modular base tile 102. For example, as shown in FIG. 20, each of game components 188*e-h* have a width that is half of the modular base tile 102 (e.g., the width of a single grid square 150). According to some aspects of the present disclosure, the game components 188*a-i* can also be magnetically attracted to the modular game tiles by way of magnets disposed therein. For example, the base 192 of the game component 188*a* can included a ferrous material, and the modular game tile 102 can have one or more magnets disposed therein (see, e.g., FIG. 5), thereby magnetically attracting, and securing, the game component 188*a* to the modular base tile 102.

Figure 22:
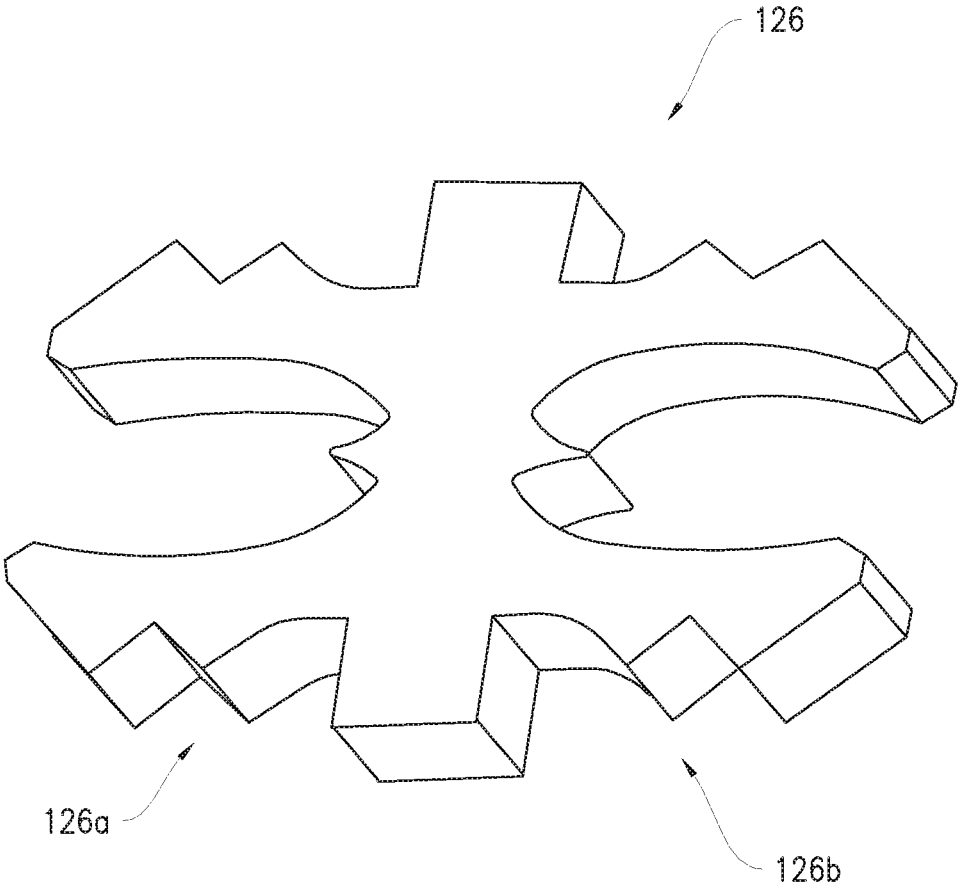
FIG. 22 is a perspective view of a locking clip according to the present disclosure.
Figure 23:
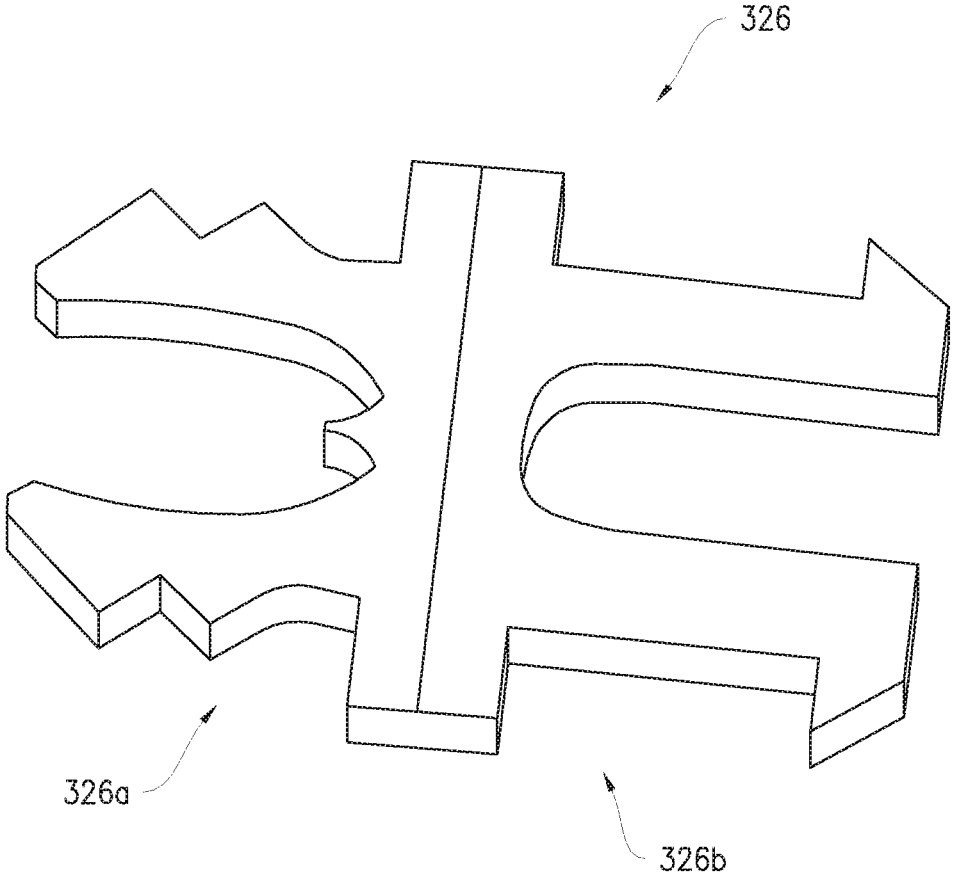
FIG. 23 is a perspective view of another locking clip according to the present disclosure.

FIGS. 22 and 23 illustrate locking clips for use with the tile game system 100 of the present disclosure. More specifically, FIG. 22 is a perspective view of the locking clip 126 having a first half 126*a* configured to engage a first game component disclosed herein and a second half 126*b* configured to engage a second game component disclosed herein. FIG. 23 is perspective view of a locking clip 326 having a first half 326*a* configured to engage a first game component disclosed herein and a second half 326*b* configured to engage a second component that is different from the first game component. For example, first halves 126*a* and 326*a* and second half 126*b* can be similar and can be configured to engage the modular tiles (e.g., tiles 102, 104, 106, etc.), boundaries (e.g., boundaries 110, 710, etc.), and other components of the present disclosure. Conversely, the second half 326*b* shown in FIG. 23 can be configured to engage different components having different locking mechanisms. Furthermore, the second half 326*b* can encompass a plurality of different configurations and game component attachment systems, in addition to the double pronged structure shown in FIG. 23. As such, locking clip 326 can include the first half 326*a* and any one of a plurality of second halves 326*b* specifically configured to be coupled to a specific game component. Accordingly, locking clip 326 can be configured to couple the game components of the present disclosure to other systems having distinct components and locking systems. Further still, the second half 326*b* of locking clip 326 can comprise a game component. Thus, according to some aspects of the present disclosure, the first half 326*a* of locking clip 326 can be coupled (e.g., permanently or removably) to a game component, such that a game component having the first half 326*a* of locking clip 326 can be coupled to, and used in connection with, the game components disclosed herein.

Having thus described the system and method in detail, it is to be understood that the foregoing description is not intended to limit the spirit or scope thereof. It will be understood that the embodiments of the present disclosure described herein are merely exemplary and that a person skilled in the art may make any variations and modification without departing from the spirit and scope of the disclosure. All such variations and modifications, including those discussed above, are intended to be included within the scope of the disclosure.

What is claimed is:

1. A tile game system, comprising:

at least two modular base tiles;

at least one exterior boundary;

at least one interior boundary; and a plurality of locking clips, the plurality of locking clips configured to removably secure the at least two modular base tiles adjacent to each other and configured to removably secure at least one of the modular base tiles to the at least one exterior boundary;

the at least one interior boundary including at least one attachment section that extends between the adjacent modular base tiles, thereby securing the interior boundary in a vertical position.

2. The system of claim 1, wherein the attachment section is one or more of a plate, a post, or a tab extending from a bottom edge of the at least one interior boundary.

3. The system of claim 2, wherein the interior boundary includes a recessed section positioned adjacent to and along a top surface of at least one of the modular base tiles, the recessed section sized to accept a portion of a base of a game figure positioned on the top surface of the at least one modular base tile.

4. The system of claim 1, wherein each of the at least two modular base tiles includes a first game surface having a first floor appearance and a second game surface having a second floor appearance.

5. The system of claim 1, wherein the exterior boundary includes a recessed section positioned adjacent to and along a top surface of a modular base tile secured thereto, the recessed section sized to accept a portion of a base of a game figure positioned on the top surface of the modular base tile secured to the exterior boundary.

6. The system of claim 1, wherein each of the at least two modular base tiles includes at least one magnet positioned therein, the at least one magnet configured to secure a game piece positioned on one of the at least two modular base tiles.

7. The system of claim 1, comprising a magnetized locking clip and an interior boundary comprising a ferrous material, the magnetized locking clip removably securing a first modular base tile to an adjacent second modular base tile, the interior boundary comprising the ferrous material arranged between the first and second adjacent modular base tiles and over the magnetized locking clip.

8. The system of claim 7, wherein the interior boundary comprising the ferrous material includes one or more tabs extending therefrom and at least one of the first and second adjacent modular base tiles includes one or more reciprocal notches, the magnetized locking clip, the one or more tabs, and the one or more notches cooperating to secure the interior boundary comprising the ferrous material in a vertical position.

9. The system of claim 1, wherein the interior boundary includes one or more notches in a lower edge thereof and at least one of the adjacent modular base tiles includes one or more reciprocal tabs protruding therefrom, the one or more notches and the one or more tabs cooperating to secure the interior boundary in a vertical position.

10. The system of claim 1, comprising one or more tile veneers having a front face with a design texture and a rear face including or more protrusions, the one or more protrusions engaging apertures in side faces of the modular base tiles, thereby obscuring the apertures from view with the design texture.

11. The system of claim 1, comprising an adjustable internal boundary including one or more stabilized sections including a plate for securing the stabilized sections between adjacent modular base tiles in a vertical orientation, one or more non-stabilized sections, and one or more hinges joining the one or more stabilized sections and the one or more non-stabilized sections together.

12. The system of claim 11, wherein at least one of the modular tiles is a square having a length and width of two units and wherein each of the one or more stabilized sections and the one or more non-stabilized sections have a width of about one unit.

13. The system of claim 1, comprising an illuminated exterior boundary including a docking section with a recess and a tile segment with a light source, the tile segment configured to be removably received within the recess of the docking section.

14. The system of claim 13, wherein the tile segment includes an opening on a front face thereof adjacent to the light source, the opening configured to removably receive a light transmitting element.

15. The system of claim 14, wherein the tile segment includes a channel formed along a side thereof between the front face and a rear face of the tile segment, the channel sized to fit onto and engage a top edge of the at least one internal boundary and a top edge of a rear wall of the docking section.

16. The system of claim 1, comprising an illuminated modular tile, the illuminated modular tile including a base having a light source and a light permeable skin removably attached to the base.

17. The system of claim 16, wherein the light permeable skin includes opaque areas and light permeable areas arranged in a design, the light source visible through the light permeable areas, thereby illuminating the design of the light permeable areas.

18. The system of claim 17, wherein operation of two or more illuminated modular tiles can be controlled by a control unit to produce a unified lighting effect.

19. The system of claim 16, wherein the light source is controlled by a pressure operated switch, the pressure operated switch being actuated by pressure applied to a top surface of the illuminated modular tile.

20. The system of claim 1, comprising an illuminated interior boundary including a base tile, a vertically arranged backlight mounted to an edge of the base tile, and at least one light permeable skin including opaque areas and light permeable areas arranged in a design, the at least one light permeable skin removably attached to the backlight such that the light permeable areas are illuminated thereby.

* * * * *